US008253718B2

(12) United States Patent
Tada et al.

(10) Patent No.: US 8,253,718 B2
(45) Date of Patent: Aug. 28, 2012

(54) POWER CONSUMPTION REDUCTION DEVICE, VISIBILITY IMPROVEMENT DEVICE, SELF-LUMINOUS DISPLAY APPARATUS, IMAGE PROCESSING DEVICE, ELECTRONIC EQUIPMENT, POWER CONSUMPTION REDUCTION METHOD, VISIBILITY IMPROVEMENT METHOD, AND COMPUTER PROGRAM

(75) Inventors: Mitsuru Tada, Kanagawa (JP); Atsushi Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 1386 days.

(21) Appl. No.: 11/892,725

(22) Filed: Aug. 27, 2007

(65) Prior Publication Data

US 2008/0062208 A1 Mar. 13, 2008

(30) Foreign Application Priority Data

Sep. 13, 2006 (JP) ..... 2006-247463

(51) Int. Cl.
*G09G 5/00* (2006.01)

(52) U.S. Cl. ..... 345/211

(58) Field of Classification Search ..... 345/102–104, 345/211

See application file for complete search history.

(56) References Cited

U.S. PATENT DOCUMENTS

2005/0122287 A1* 6/2005 Nishitani et al. ..... 345/63

FOREIGN PATENT DOCUMENTS

| | | |
|---|---|---|
| JP | 63-084526 A | 4/1988 |
| JP | 04-188374 A | 7/1992 |
| JP | 07-036422 A | 2/1995 |
| JP | 2004-109170 | 4/2004 |

OTHER PUBLICATIONS

Japanese Office Action issue Feb. 7, 2012 for corresponding Japanese Application No. 2006-247463.

* cited by examiner

*Primary Examiner* — Ke Xiao

(74) *Attorney, Agent, or Firm* — Rader, Fishman & Grauer PLLC

(57) ABSTRACT

A power consumption reduction device includes a region-adaptive gray level conversion unit wherein the gray level conversion unit is operable to convert n1 bits of gray level information for a low gray level region into m1 (<n1) bits of gray level information, further operable to convert n2 bits of gray level information for an intermediate gray level region into m2 (≦n2) bits of gray level information, and still further operable to convert n3 bits of gray level information for a high gray level region into m3 (<n3) bits of gray level information, and the gray level conversion unit converts a gray level of an input video signal so that m1≦m2, m3≦m2 and n1+n2+n3>m1+m2+m3 are all satisfied.

19 Claims, 35 Drawing Sheets

FIG. 5

LOW GRAY LEVEL REGION (4 BITS)

$$\text{OUTPUT GRAY LEVEL} = \text{NINT}\{\underbrace{\text{NINT}[\text{INPUT GRAY LEVEL} \div ((\text{APL}-64) \div 16)]}_{\text{STEP COUNT}} \times \underbrace{[(\text{APL}-64) \div 16]}_{\text{UNIT STEP COUNT}}\}$$

INTERMEDIATE GRAY LEVEL REGION (6 BITS)

$$\text{OUTPUT GRAY LEVEL} = \underbrace{(\text{APL}-64)}_{\text{OFFSET}} + \text{NINT}\{\underbrace{\text{NINT}[(\text{INPUT GRAY LEVEL}-\text{APL}+64) \div (128 \div 64))]}_{\text{STEP COUNT}} \times \underbrace{(128 \div 64)}_{\text{UNIT STEP COUNT}}\}$$

HIGH GRAY LEVEL REGION (4 BITS)

$$\text{OUTPUT GRAY LEVEL} = \underbrace{(\text{APL}+64)}_{\text{OFFSET}} + \text{NINT}\{\underbrace{\text{NINT}[(\text{INPUT GRAY LEVEL}-\text{APL}-64) \div ((255-\text{APL}-64) \div 16)]}_{\text{STEP COUNT}} \times \underbrace{(255-\text{APL}-64) \div 16}_{\text{UNIT STEP COUNT}}\}$$

VERTICAL SYNCHRONIZING PULSE

DUTY PULSE SIGNAL

FIG.13

| INPUT GRAY LEVEL | OUTPUT GRAY LEVEL |
|---|---|
| 0 | 0 |
| 1 | 0 |
| 2 | 0 |
| 3 | 0 |
| 4 | 4 |
| 5 | 4 |
| ⋮ | ⋮ |
| 250 | 297 |
| 251 | 251 |
| 252 | 251 |
| 253 | 251 |
| 254 | 251 |
| 255 | 255 |

VERTICAL SYNCHRONIZING PULSE

DUTY PULSE SIGNAL

HORIZONTAL SYNCHRONIZING PULSE

DUTY PULSE SIGNAL

POWER CONSUMPTION REDUCTION DEVICE, VISIBILITY IMPROVEMENT DEVICE, SELF-LUMINOUS DISPLAY APPARATUS, IMAGE PROCESSING DEVICE, ELECTRONIC EQUIPMENT, POWER CONSUMPTION REDUCTION METHOD, VISIBILITY IMPROVEMENT METHOD, AND COMPUTER PROGRAM

CROSS REFERENCES TO RELATED APPLICATIONS

The present invention contains subject matter related to Japanese Patent Application JP 2006-247463 filed in the Japan Patent Office on Sep. 13, 2006, the entire contents of which being incorporated herein by reference.

BACKGROUND OF THE INVENTION

1. Field of the Invention

The invention described in the present specification relates to a technology for reducing power consumption while at the same time keeping a decline in visibility in high ambient illuminance conditions to a minimum and also to a technology for providing improved visibility while at the same time keeping an increase in power consumption to a minimum.

The invention proposed by the inventors includes a power consumption reduction device, a visibility improvement device, a self-luminous display apparatus, an image processing device, electronic equipment, a power consumption reduction method, a visibility improvement method, and a computer program.

2. Description of the Related Art

Today, flat panel displays are finding widespread application in various types of electronic equipment. As a result, these displays are used in ever more diverse operating conditions. For example, such displays are increasingly used in extremely high ambient illuminance conditions.

Incidentally, screens suffer a sharp decline in visibility if used under high illuminance conditions. In this case, the screen brightness has to be increased to provide improved visibility.

Japanese Patent Laid-Open No. 2004-109170 discloses a peak brightness control technique of changing the peak brightness in accordance with the luminance of ambient light. That is, the technique disclosed includes increasing the peak brightness in light conditions, and reducing the peak brightness in dark conditions.

SUMMARY OF THE INVENTION

However, increasing the screen brightness typically leads to higher power consumption. With a self-luminous flat panel display in particular, higher screen brightness results directly in higher power consumption. Further, increased power consumption translates directly into shorter usage time in the case of mobile electronic equipment.

Therefore, the inventors propose a power consumption reduction device having a region-adaptive gray level conversion unit. The gray level conversion unit converts n1 bits of gray level information for a low gray level region into m1 (<n1) bits of gray level information. Further, the gray level conversion unit converts n2 bits of gray level information for an intermediate gray level region into m2 (≦n2) bits of gray level information. Still further, the gray level conversion unit converts n3 bits of gray level information for a high gray level region into m3 (<n3) bits of gray level information. The gray level conversion unit converts a gray level of an input video signal so that the conditions that m1≦m2, m3≦m2 and n1+n2+n3>m1+m2+m3 are all satisfied.

If ambient illuminance is high, low and high gray level regions typically decline in visibility as compared to an intermediate gray level region. The technique proposed by the inventors provides active reduction of gray level information in these gray level regions. This permits reduction of power consumption while not affecting the actual visibility.

It should be noted that improved visibility can be achieved as compared to the existing art if the peak brightness is increased to the extent that power consumption is reduced as a result of this gray level conversion. That is, the screen visibility can be enhanced while maintaining power consumption constant.

BRIEF DESCRIPTION OF THE DRAWINGS

FIG. 5 is a view illustrating examples of gray level conversion formulas for different gray level regions;

FIG. 13 is a view illustrating an example of structure of a conversion table;

DETAILED DESCRIPTION OF THE PREFERRED EMBODIMENTS

A description will be made below about power consumption reduction and visibility improvement techniques according to an embodiment of the present invention.

It should be noted that known or publicly known technologies of the technical field concerned will be applied to those portions not specifically illustrated or described.

It is also to be noted that the embodiments described below are preferred embodiments of the invention. The present invention is not limited thereto.

(A) Embodiment 1

(A-1) Functional Configuration of Power Consumption Reduction Device

Figure 1:
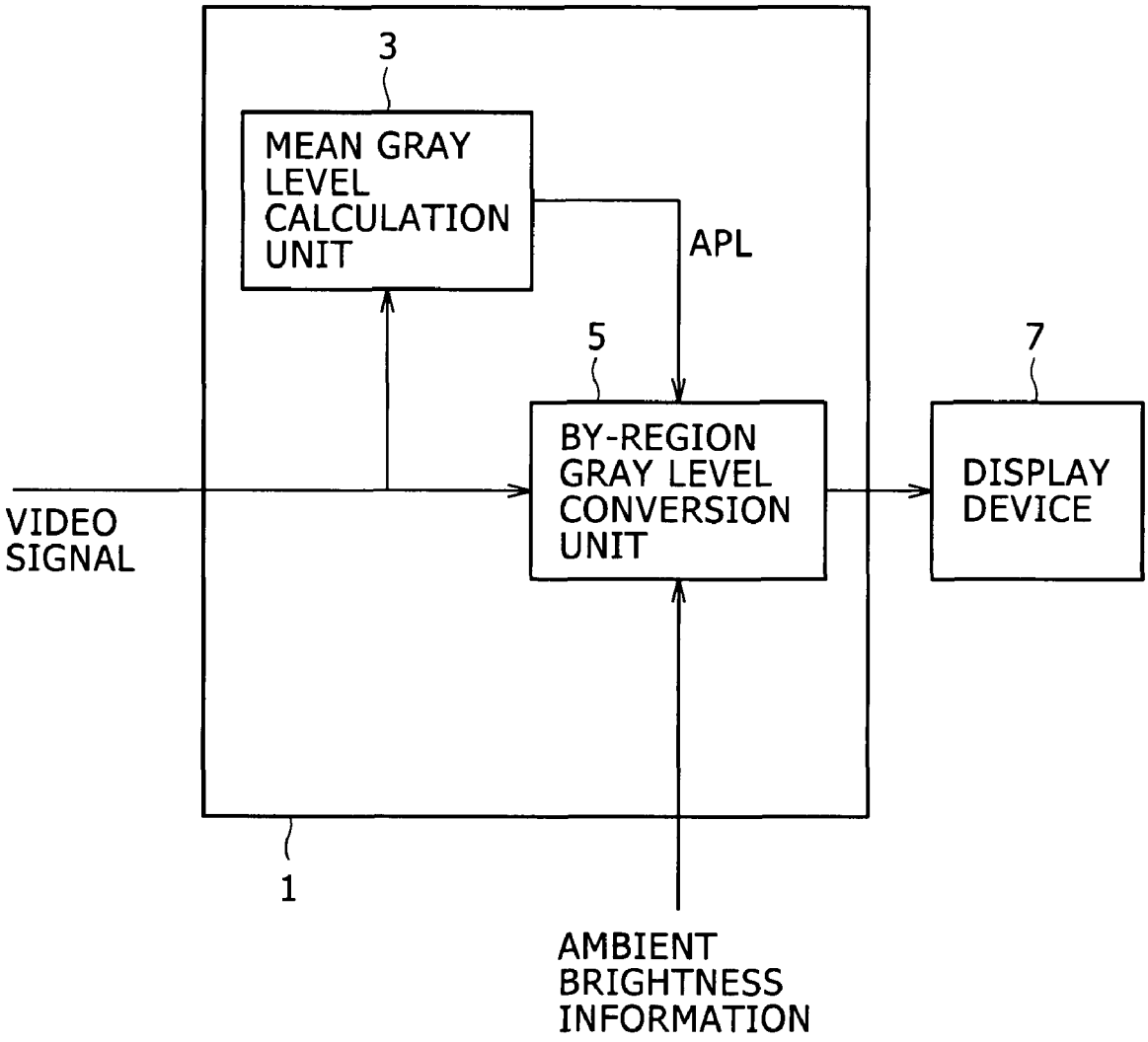
FIG. 1 is a view illustrating an example of functional configuration of a power consumption reduction device.

FIG. 1 is a view illustrating an example of functional configuration of a power consumption reduction device.

A power consumption reduction device 1 includes a mean gray level calculation unit 3 and a by-region gray level conversion unit 5.

The mean gray level calculation unit 3 is a processing device operable to calculate a mean gray level (APL: average picture level) per frame based on a video signal. It should be noted that the mean gray level may be calculated on a frame-by-frame basis or as a mean level per frame of video signal input during a plurality of frames.

The by-region gray level conversion unit 5 is a processing device operable to preserve much gray level information in a given range set around a mean gray level and also actively reduce gray level information in the low and high gray level regions if ambient brightness is high. It should be noted that when ambient brightness is not high (when ambient brightness is lower than a determination threshold level), the same unit 5 outputs the video signal as is without converting it.

Figure 2:
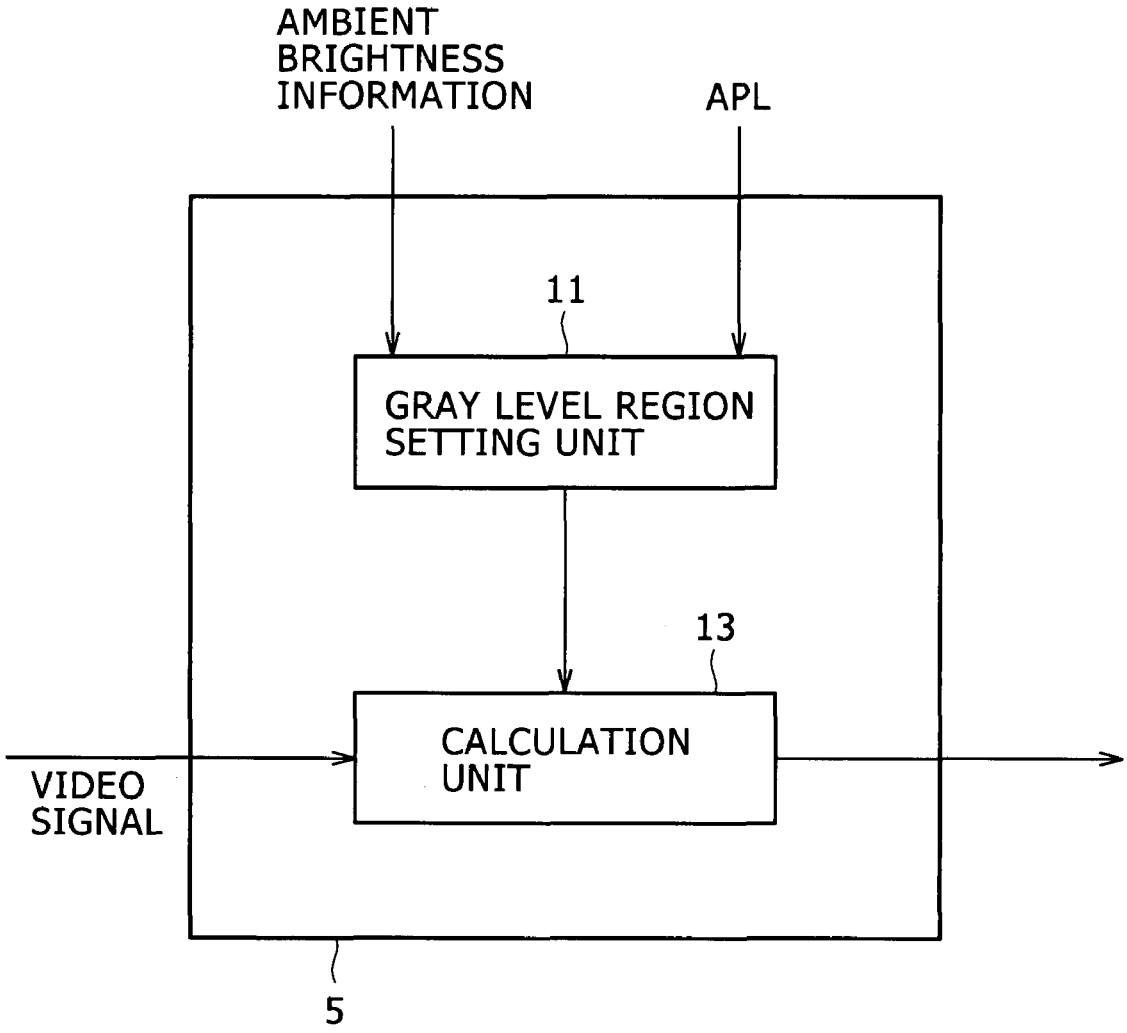
FIG. 2 is a view illustrating an example of internal configuration of a by-region gray level conversion unit.

FIG. 2 is a view illustrating an example of internal configuration of the by-region gray level conversion unit 5. The same unit 5 includes a gray level region setting unit 11 and a calculation unit 13.

If ambient brightness is high, the gray level region setting unit 11 sets low, intermediate and high gray level regions based on a mean gray level. When ambient brightness is not high, the same unit 11 stops setting gray level regions.

In the present embodiment, the gray level region setting unit 11 performs the calculations of (mean gray level−total gray level region/2) and (mean gray level+total gray level region/2). Then the same unit 11 sets three gray level regions based on these two gray levels.

That is, the same unit 11 sets, as an intermediate region, a region between (mean gray level−total gray level region/2) and (mean gray level+total gray level region/2). Further, the same unit 11 sets, as a low gray level region, a region smaller than (mean gray level−total gray level region/2). Still further, the same unit 11 sets, as a high gray level region, a region greater than (mean gray level+total gray level region/2).

Figure 3:
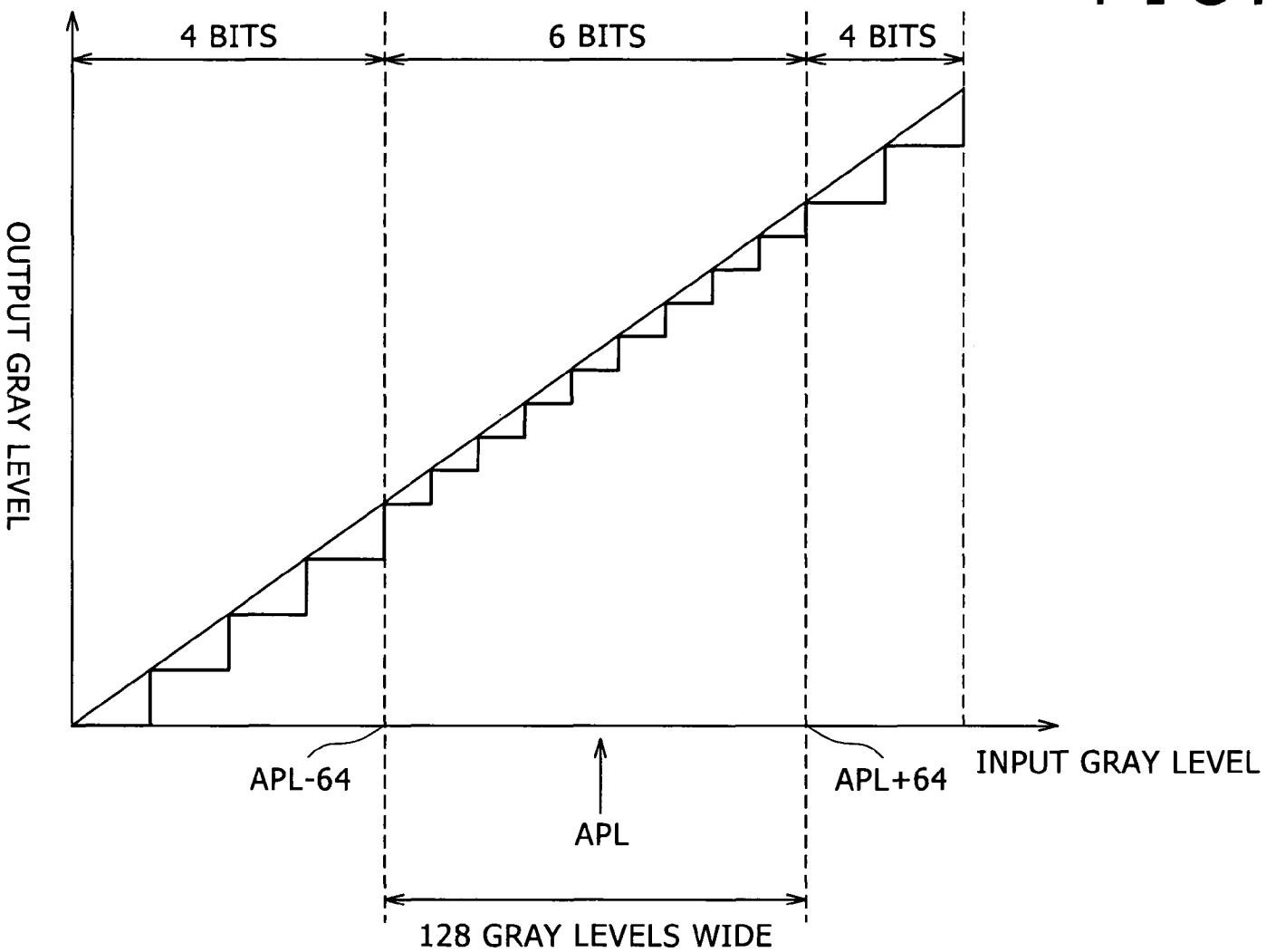
FIG. 3 is a view explaining an example of setting gray level regions for a mean gray level and the relationship thereof with assignment of gray level information.

FIG. 3 illustrates an example of setting gray level regions for a mean gray level. The example illustrated in FIG. 3 assumes that the video signal is eight bits wide (video signal with 256 gray levels). Therefore, the intermediate gray level region is set as 128 gray levels wide. On one hand, the boundary between the low and intermediate gray level regions is given by subtracting 64 from a mean gray level. On the other hand, the boundary between the intermediate and high gray level regions is given by adding 64 to the mean gray level.

For example, if the mean gray level is 128, the low gray level region is from 1 to 64. Similarly, the intermediate and high gray level regions are respectively from 65 to 191 and from 192 to 256.

Figure 4A:
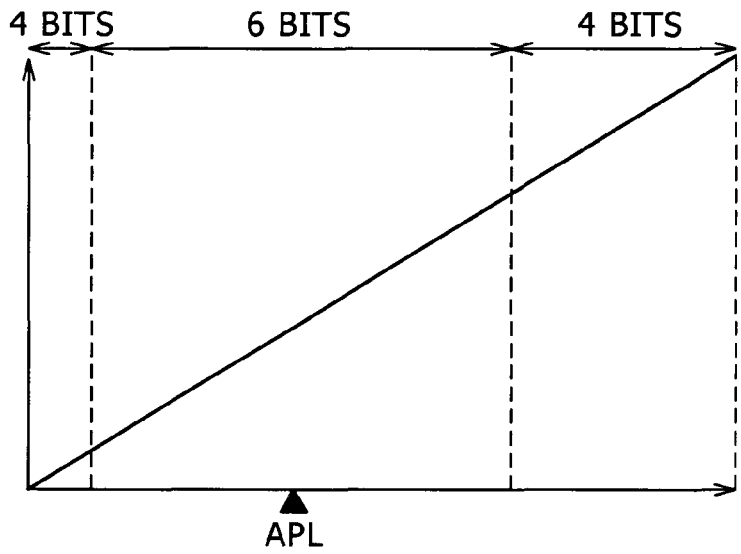
FIGS. 4A, 4B and 4C are views illustrating how the setting of each gray level region changes with different mean gray levels.
Figure 4B:
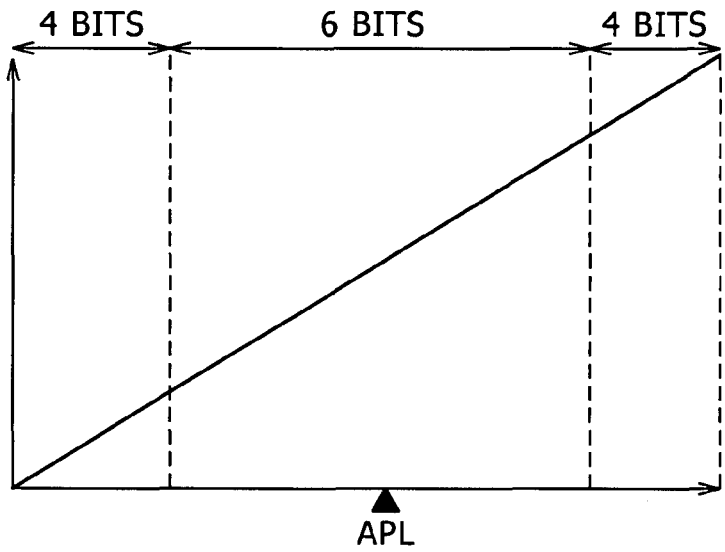
Figure 4C:
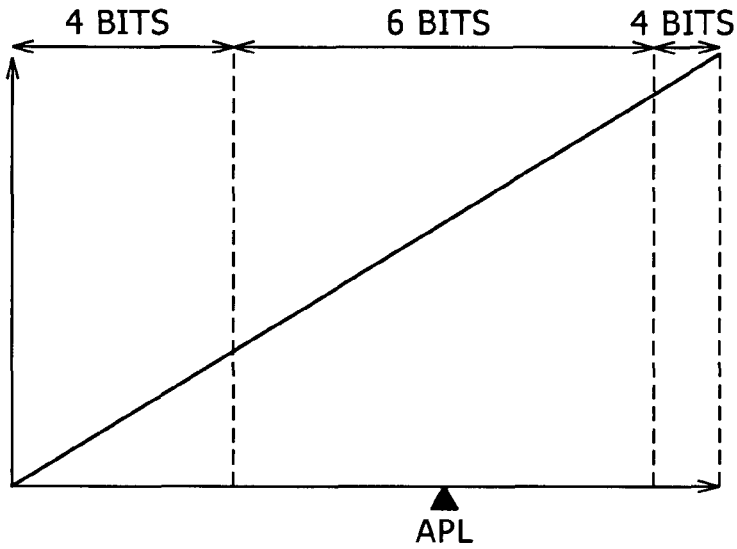

FIGS. 4A, 4B and 4C illustrate how the setting of each gray level region changes in accordance with different mean gray levels. It should be noted that we assumed that the width of the intermediate gray level region remains unchanged irrespective of different mean gray levels. FIG. 4A illustrates a case where the mean gray level is small. In this case, the low gray level region is narrow, whereas the high gray level region is wide.

FIG. 4B illustrates a case where the mean gray level is some intermediate value which is neither small nor large. In this case, the low and high gray level regions are almost equal in width. FIG. 4C illustrates a case where the mean gray level is large. In this case, the low gray level region is wide, whereas the high gray level region is narrow.

The calculation unit 13 performs gray level conversion by arithmetic operation. The same unit 13 carries out conversion according to the gray level region to which the video signal (gray level) for each pixel belongs.

In the present embodiment, we assume that gray level information (bit count) assigned to each gray level region is set in advance.

In the case illustrated in FIG. 3, four bits (16 gray levels) of gray level information are assigned to the low gray level region. Six bits (64 gray levels) are assigned to the intermediate gray level region. Four bits (16 gray levels) are assigned to the high gray level region.

As a result of gray level conversion by the calculation unit 13, therefore, a video signal containing gray level information of 256 gray levels is converted into a video signal containing gray level information of 96 gray levels (=16 gray levels+64 gray levels+16 gray levels).

FIG. 5 illustrates each of the formulas applied to each of the gray level regions to which a video signal belongs. Naturally, FIG. 5 illustrates a case where the intermediate gray level region is half the size of total gray level region when an eight-bit video signal is given.

In gray level conversion, two processes are performed. The first process is a division process which divides the value, obtained by normalizing an input gray level in each gray level region, by a unit step value (step count calculation process in the same gray level region). The second process is a multiplication process which multiplies the calculated step count by a unit step value (output gray level calculation process). It should be noted that, for the intermediate and high gray level regions, an additional process is also performed which adds a gray level (offset) for the origin of each gray level region to the calculation result.

It should be noted that, in the calculation formulas illustrated in FIG. 5, an operator NINT refers to an integer generation process by rounding.

For example, when the mean gray level is 128, a video signal (gray level) belonging to the low gray level region is converted into a video signal whose gray level changes in a step form in units of four gray levels.

Similarly, when the mean gray level is 128, a video-signal (gray level) belonging to the intermediate gray level region is converted into a video signal whose gray level changes in a step form in units of two gray levels.

Similarly, when the mean gray level is 128, a video signal (gray level) belonging to the high gray level region is converted into a video signal whose gray level changes in a step form in units of two gray levels.

FIG. 3 illustrates this input and output relationship as a bold line in a step form. It should be noted that the input and output relationship is linear as shown by a fine line in FIG. 3 when the gray level conversion is not performed. The result of the gray level conversion performed selectively according to the ambient brightness as described above is output to a display device 7.

(A-2) Configuration of the Display Device

In the present embodiment, we assume that an organic EL display, a type of self-luminous display device, is used as a display device.

Figure 6:
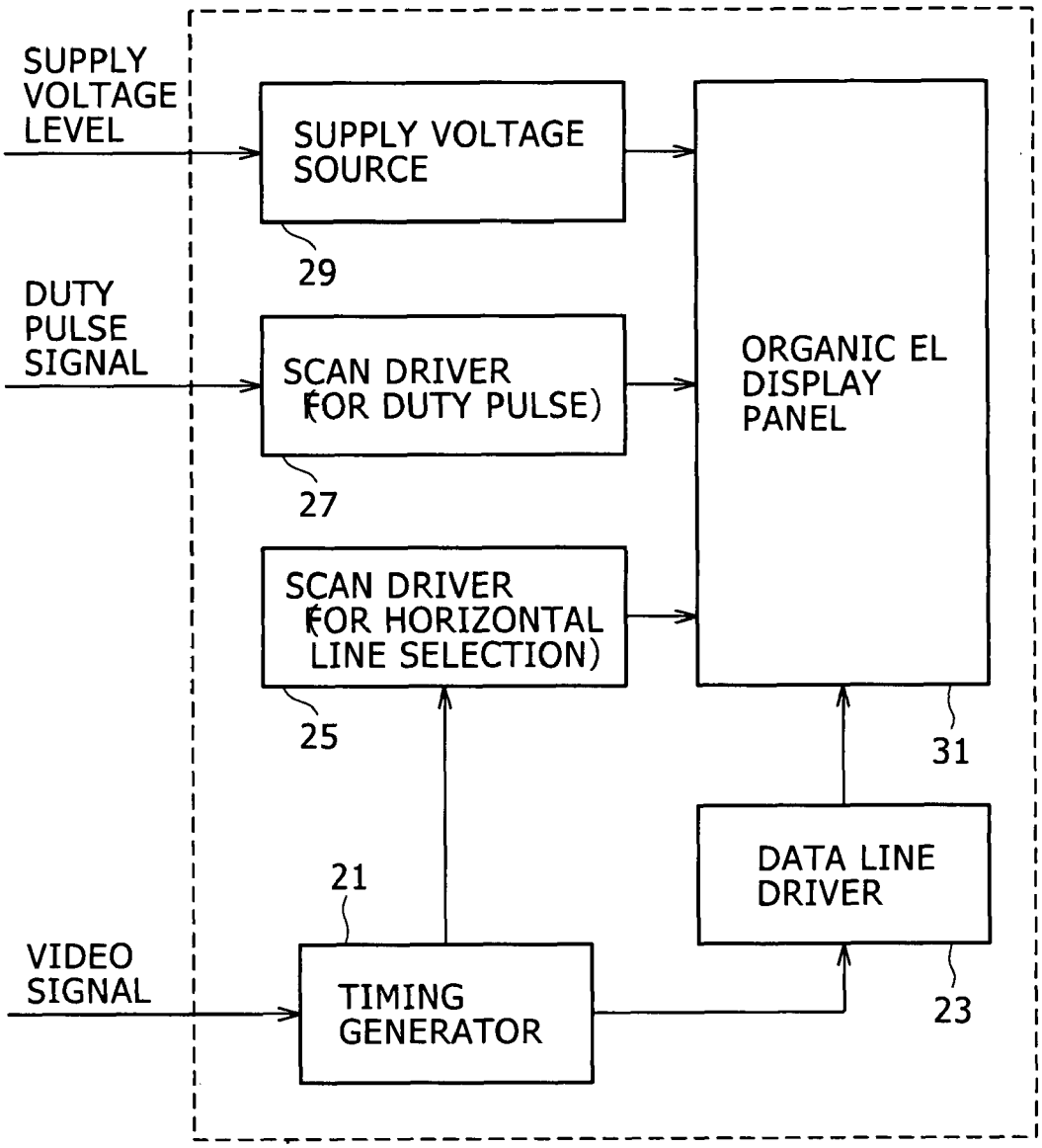
FIG. 6 is a view illustrating an example of functional configuration of a display device.

FIG. 6 illustrates an example of functional configuration of the display device 7. The display device 7 includes a timing generator 21, a data line driver 23, scan drivers 25 and 27, a supply voltage source 29 and an organic EL display panel 31.

The timing generator 21 is a processing device operable to generate various timing signals necessary for screen display based on a timing signal contained in a video signal given by the power consumption reduction device 1. The timing generator 21 generates, for example, a write pulse.

The data line driver 23 is a circuit device operable to drive the data line of the organic EL display panel 31.

The data line driver 23 converts a gray level specifying the luminescent brightness of each pixel into an analog voltage level and supplies the analog voltage to the data line.

The scan driver 25 is a circuit device operable to select a gate line, which is provided for selection of a horizontal line to which a gray level is written, in a line sequential manner. This selection signal is supplied to the organic EL display panel 31 as a write pulse. In the present embodiment, the scan driver 25 outputs a write pulse to each of the horizontal lines.

Figures 7A, 7B:
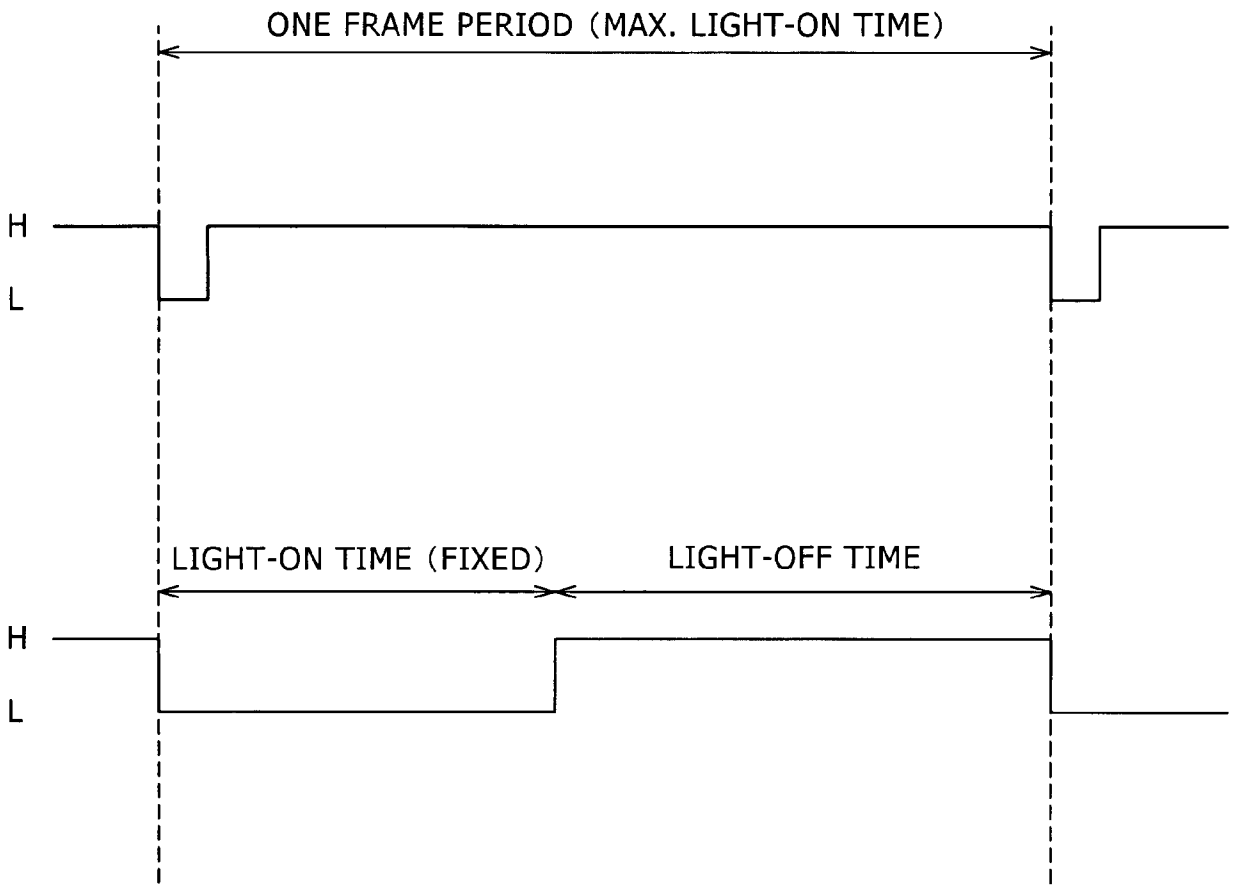
FIGS. 7A and 7B are views explaining a duty pulse signal.

The scan driver 27 is a circuit device operable to drive a gate line provided to supply a duty pulse signal. Here, the duty pulse signal refers to a signal which gives the duration of light-on time in one frame period. An example of a duty pulse signal is illustrated in FIGS. 7A and 7B. FIG. 7A illustrates a vertical synchronizing pulse which gives the maximum duration of light-on time. FIG. 7B illustrates an example of a duty pulse signal. In the case of FIG. 7B, the low-level period of the duty pulse signal is the duration of light-on time in one frame period. In the present embodiment, it is assumed that the light-on time is fixed.

The supply voltage source 29 is a circuit device operable to supply a supply voltage (analog voltage) to be applied to the anode of the organic EL device. In the present embodiment, the supply voltage source 29 generates a constant voltage.

The organic EL display panel 31 is a display device with organic EL devices arranged in a matrix form. It should be noted that the organic EL display panel 31 is designed for color display. Therefore, one pixel on the display includes sub-pixels for three colors of RGB.

Figure 8:
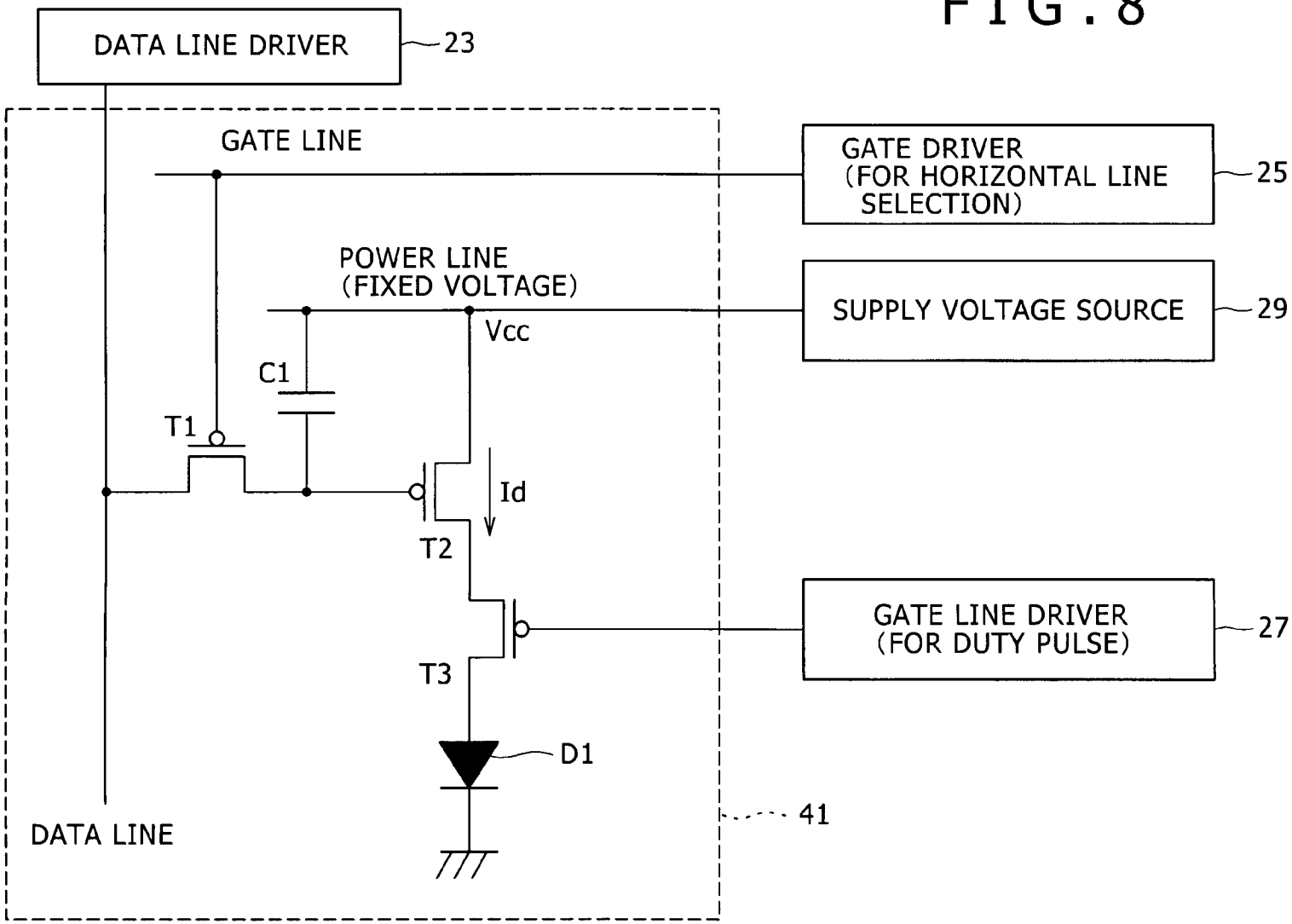
FIG. 8 is a view illustrating the connection relationship between a pixel circuit and peripheral circuits.

FIG. 8 illustrates the connection relationship between a pixel circuit 41 and peripheral circuits.

The pixel circuit 41 includes a data switch device T1, a capacitor C1, a current supply device T2, and a light-on period control device T3.

Here, the data switch device T1 is a transistor operable to control loading (writing) of a voltage level given via the data line. The timing of loading the voltage level is given for each horizontal line.

The capacitor C1 is a storage device operable to store the loaded voltage level for a period of one frame. Even if data is written by a line sequential scan, use of the capacitor C1 provides light emission similar to that by a frame sequential scan.

The current supply device T2 is a transistor operable to supply a drive current suited for the voltage level of the capacitor C1 to an organic EL device D1.

The light-on period control device T3 is a transistor operable to control the light-on time of the organic EL device D1 within one frame.

The light-on period control device T3 is disposed in series with the supply path of the drive current. The organic EL device D1 is lit while the light-on period control device T3 is on. On the other hand, the organic EL device D1 is unlit while the light-on period control device T3 is off.

The signal applied to the light-on period control device T3 is the duty pulse signal described earlier (FIG. 7B).

(A-3) Gray Level Conversion Process

The gray level conversion performed when ambient brightness is high will be described below. It should be noted that the gray level conversion is carried out if ambient brightness information from an ambient light sensor is greater than the determination threshold level.

Figure 9:
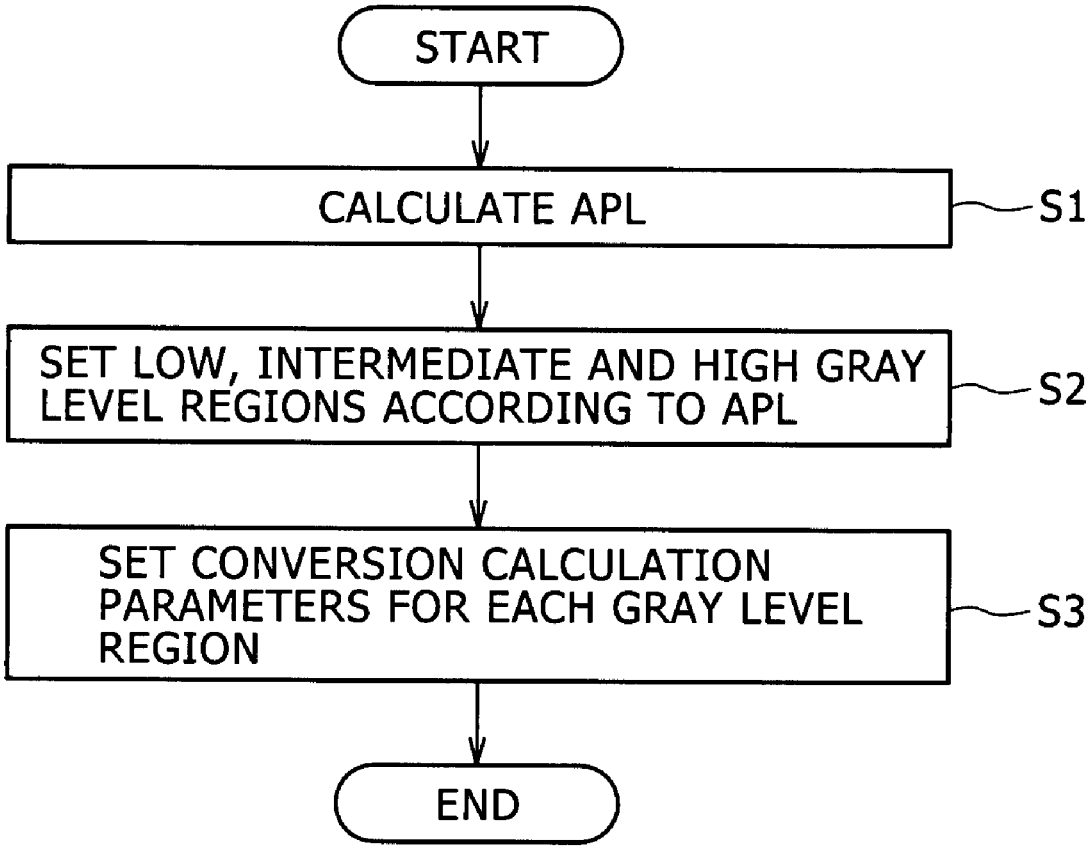
FIG. 9 is a view explaining a gray level region setting procedure.

FIG. 9 illustrates the procedure for setting gray level regions. It should be noted that the operation steps illustrated in FIG. 9 are performed every frame.

First, the power consumption reduction device 1 calculates a mean gray level per frame (S1).

Next, the power consumption reduction device 1 sets low, intermediate and high gray level regions according to the mean gray level (S2).

More specifically, when a low gray level region is set, the power consumption reduction device 1 sets conversion calculation parameters for each gray level region (S3). More specifically, the same device 1 sets parameters other than the input gray level in the calculation formulas described in FIG. 5.

Figure 10:
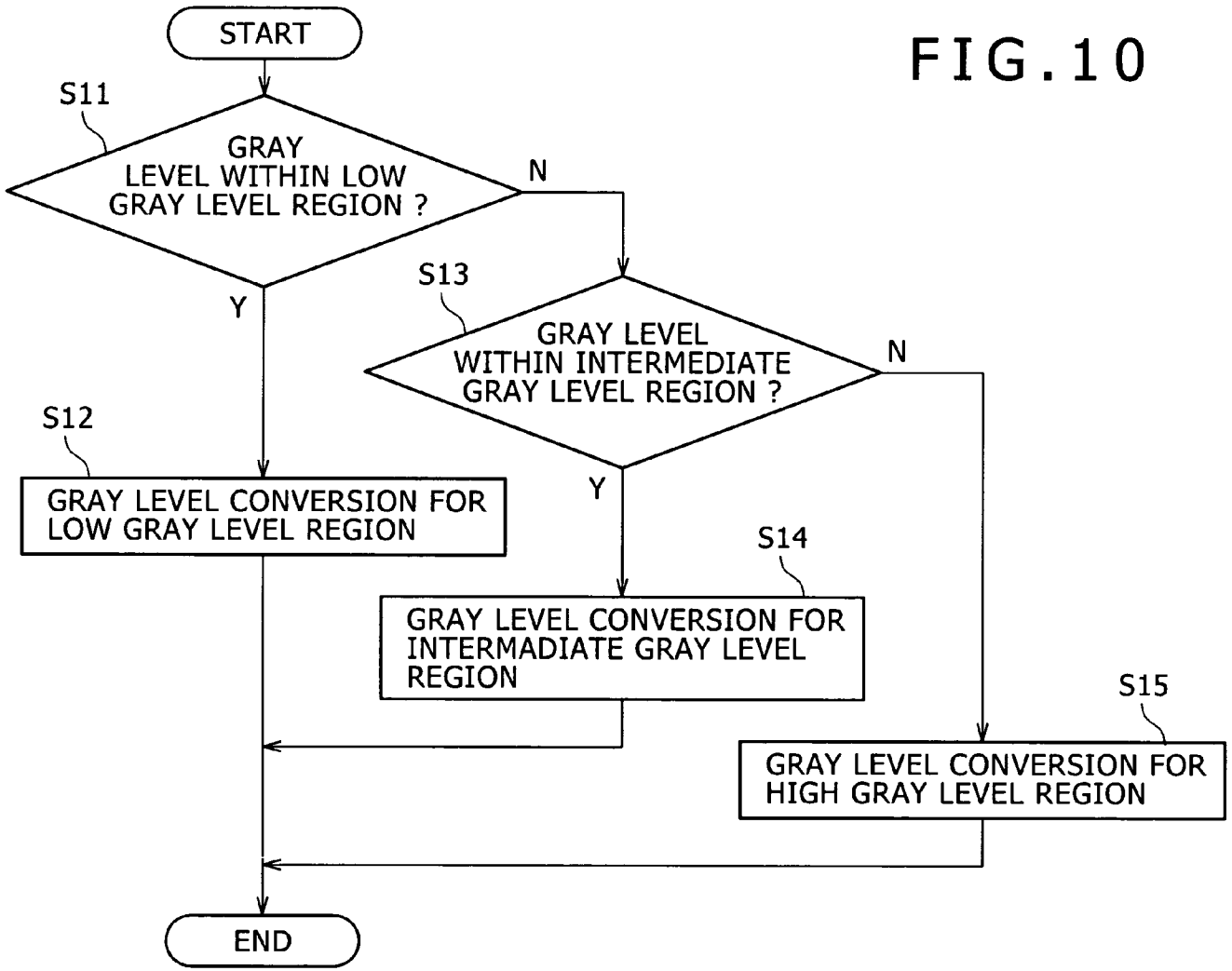
FIG. 10 is a view explaining a gray level conversion procedure.

Following the setting of parameters, the power consumption reduction device 1 performs the steps illustrated in FIG. 10 for each pixel.

First, the same device 1 determines whether the input gray level falls within the low gray level region (S11).

When the determination is affirmative, the same device 1 performs gray level conversion for the low gray level region (S12).

In contrast, if the determination is negative, the power consumption reduction device 1 determines whether the input gray level falls within the intermediate gray level region (S13).

When the determination is affirmative, the power consumption reduction device 1 performs gray level conversion for the intermediate gray level region (S14).

On the other hand, if the determination is negative, the power consumption reduction device 1 performs gray level conversion for the high gray level region (S15).

A series of the operation steps illustrated in FIG. 10 will be repeated for all pixels making up a frame. As a result, the video signal containing 256 gray levels is converted into a video signal containing 96 gray levels, which will be displayed on the screen.

(A-4) Effect of Gray Level Conversion

As described above, much gray level information is assigned to the intermediate gray level region while at the same time reducing gray level information. This permits reduction of power consumption without degrading visibility even in high ambient brightness conditions.

Figure 11:
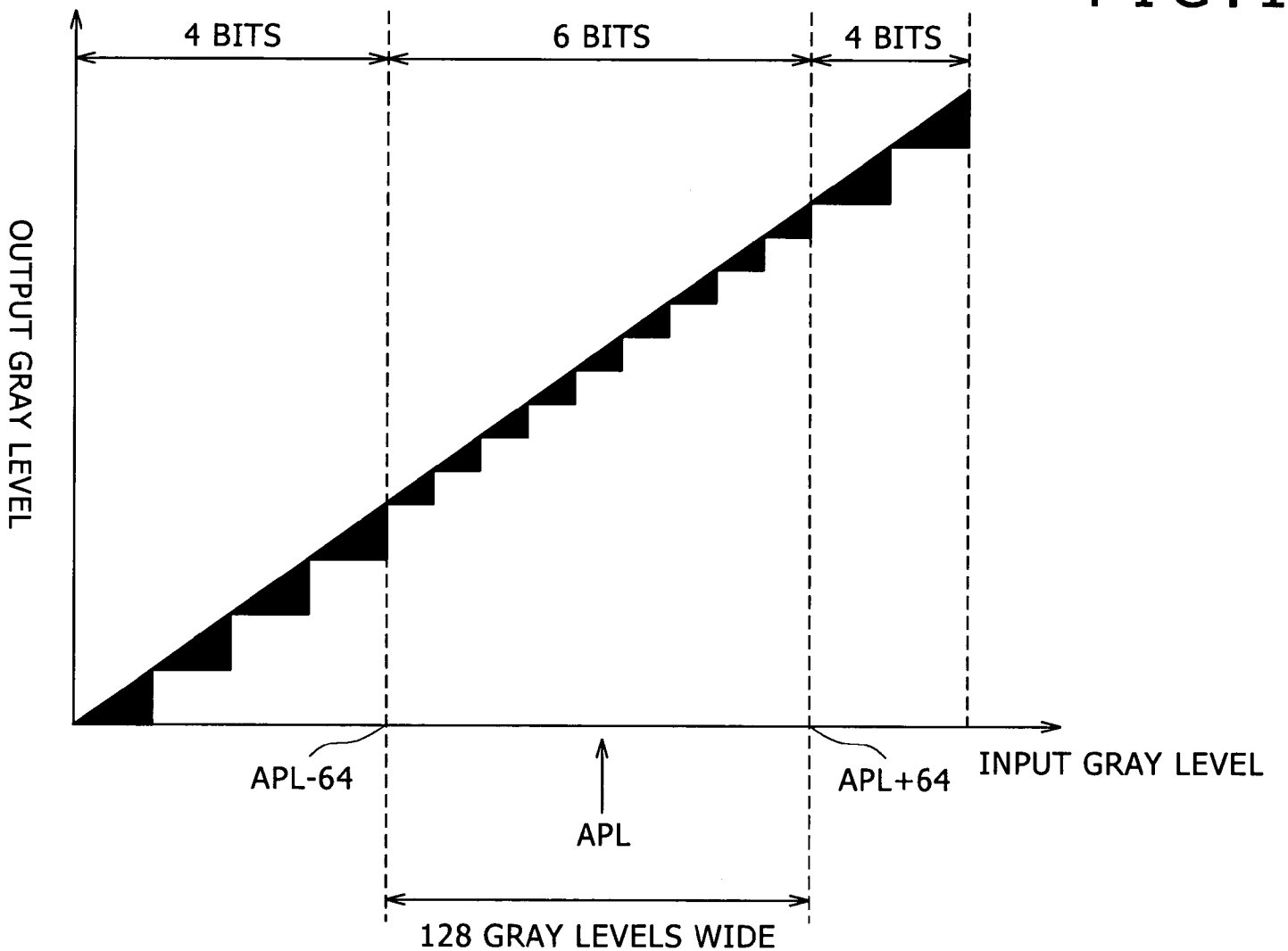
FIG. 11 is a view explaining reduction in power consumption.

FIG. 11 visually illustrates how power consumption is reduced. In FIG. 11, the areas in which power consumption is reduced and the amount of reduction are shown by a black filled-in pattern. The amount of reduction in power consumption is significant in the low and high gray level regions where gray level information has been significantly reduced.

It should be noted that, as described earlier, the observable difference in contrast is inherently small in high ambient brightness conditions. In addition, preserving much gray level information for the intermediate gray level region, which has been set relative to the mean gray level, keeps the decline in visibility to a minimum. That is, power consumption can be positively reduced without adversely affecting visibility.

In particular, if an organic EL display is used outdoors, this reduced power consumption can be used to extend the operation time.

(B) Embodiment 2

Here, a description will be made about a case where a by-region gray level conversion function is implemented using a gray level conversion table. It should be noted that the basic system configuration is identical to that of FIG. 1 described in relation to the embodiment 1, except for the internal configuration of the by-region gray level conversion unit.

Figure 12:
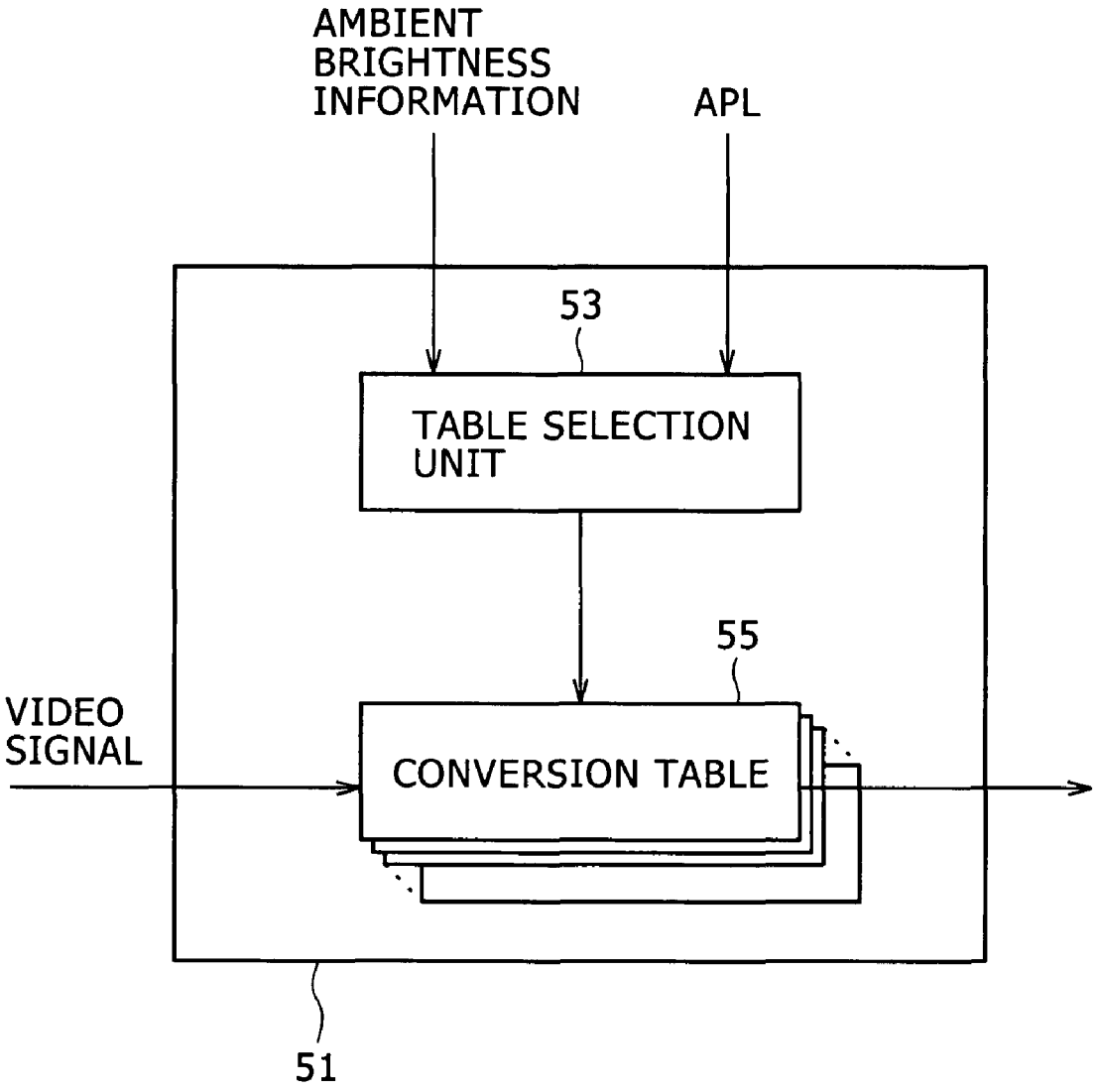
FIG. 12 is a view illustrating another example of internal configuration of the by-region gray level conversion unit.

FIG. 12 illustrates the internal configuration of a by-region gray level conversion unit 51.

The by-region gray level conversion unit 51 includes a table selection unit 53 and a conversion table 55.

The table selection unit 53 selects an optimal conversion table based on the mean gray level if ambient brightness is high. The same unit 53 stops conversion (or selects a conversion table in which the input and output gray levels are the same) when ambient brightness is not high.

The conversion table 55 includes a plurality of sets of conversion tables prepared in advance in anticipation for a calculated mean gray level. To be exact, as many conversion tables as 256 gray levels should be prepared. Practically, however, a plurality of representative sets of tables is incorporated in consideration of the frequency of use and the rate of change in gray level after conversion. As a result, the table selection unit 53 selects a conversion table which contains a calculated mean gray level within the estimated range.

FIG. 13 illustrates the structure of the conversion table 55. As illustrated in FIG. 13, the conversion table 55 stores a correspondence between input and output gray levels. Naturally, the correspondence satisfies the gray level conversion formulas for different gray level regions described in relation to the embodiment 1.

It should be noted that the conversion table illustrated in FIG. 13 stores a correspondence between all 256 input gray levels and their associated output gray levels. Alternatively, however, the conversion table may store the part of the correspondence in which the output gray level changes. Then, for those input gray levels with no associated output gray levels, the output gray level may be read which is associated with the input gray level which is smaller than and closest to the input gray level in question. Such an arrangement will permit reduction of storage capacity for storing the conversion table 55.

Figure 14:
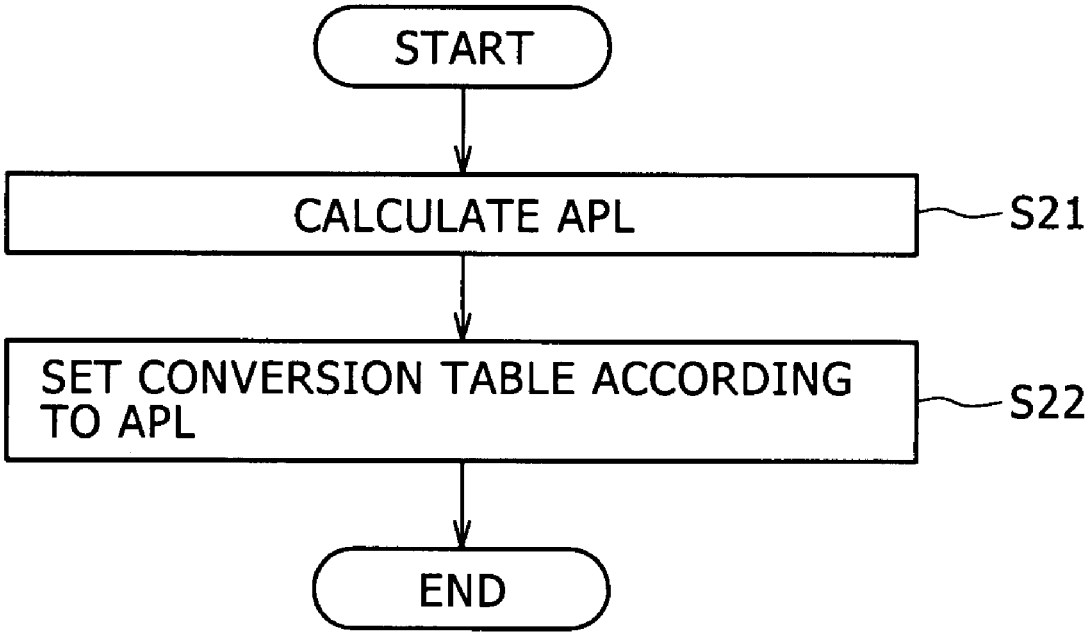
FIG. 14 is a view illustrating an example of conversion table setting procedure.

FIG. 14 illustrates the procedure for setting the conversion table. It should be noted that the operation steps illustrated in FIG. 14 are performed every frame.

Also in this case, the mean gray level calculation unit 3 calculates a mean gray level per frame (S21).

Next, the by-region gray level conversion unit 51 sets a conversion table with low, intermediate and high gray levels specified according to the mean gray level (S22).

From here onward, gray level conversion is performed continuously on a pixel-by-pixel basis using the selected conversion table.

Use of a conversion table as in the present embodiment eliminates the need to incorporate a high performance signal processing unit. Use of a conversion table is also effective if the screen size is large and if the number of bits of input video signal is large.

(C) Embodiment 3

Here, a description will be made about a case where a by-region gray level conversion function is implemented based on genre information attached to video signal. It should be noted that genre information is given as information attached to video signal.

Figure 15:
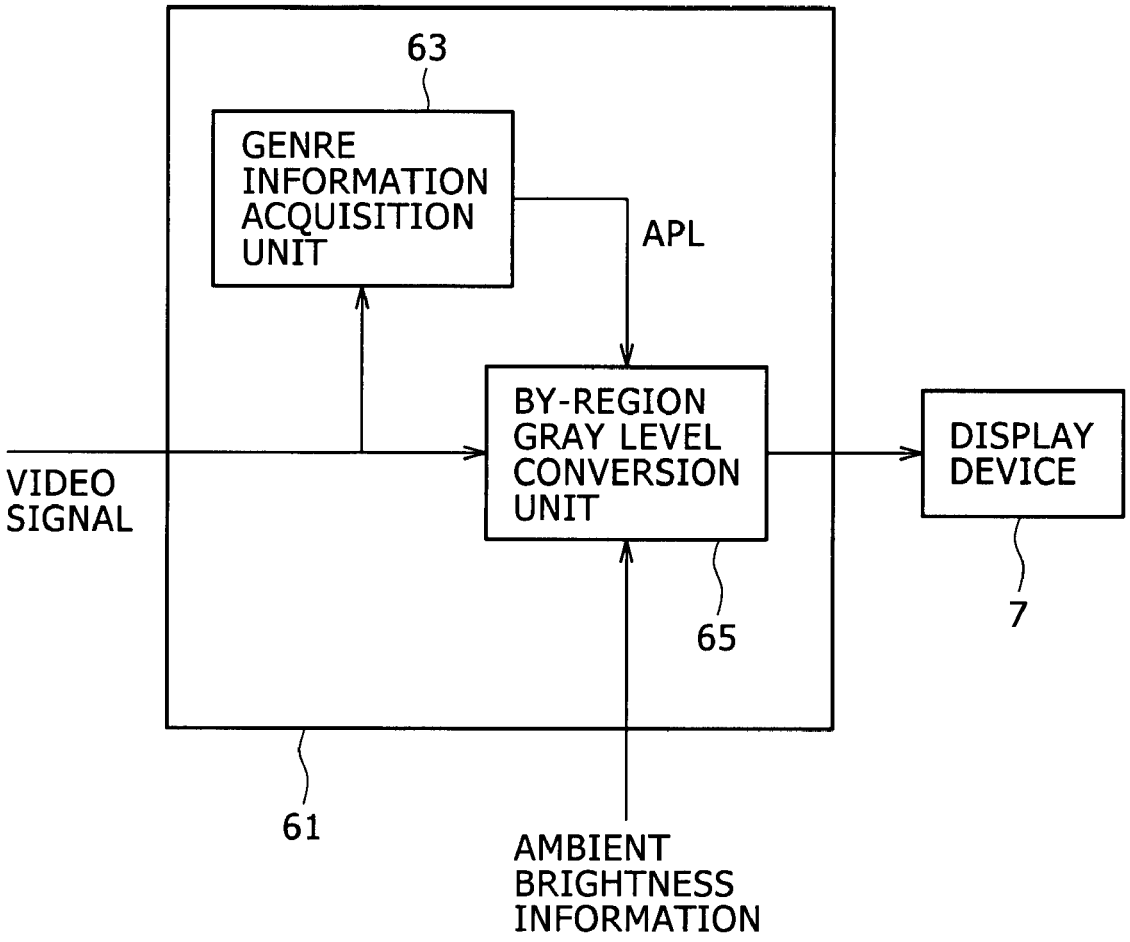
FIG. 15 is a view illustrating another example of functional configuration of the power consumption reduction device.

FIG. 15 illustrates an example of functional configuration of a power consumption reduction device 61.

The power consumption reduction device 61 includes a genre information acquisition unit 63 and a by-region gray level conversion unit 65.

The genre information acquisition unit 63 is a processing device operable to acquire genre information attached to a video signal. Genre information relates to details of program such as news, entertainment and sports. It should be noted that genre information is described, for example, in coded data format or in text data format with tags as defined by the data format.

The by-region gray level conversion unit 65 is a processing device operable to preserve much gray level information in the intermediate gray level region and actively reduce gray level information in the low and high gray level regions if ambient brightness is high. It should be noted that when ambient brightness is not high, the by-region gray level conversion unit 65 outputs the video signal as is without converting it.

Figure 16:
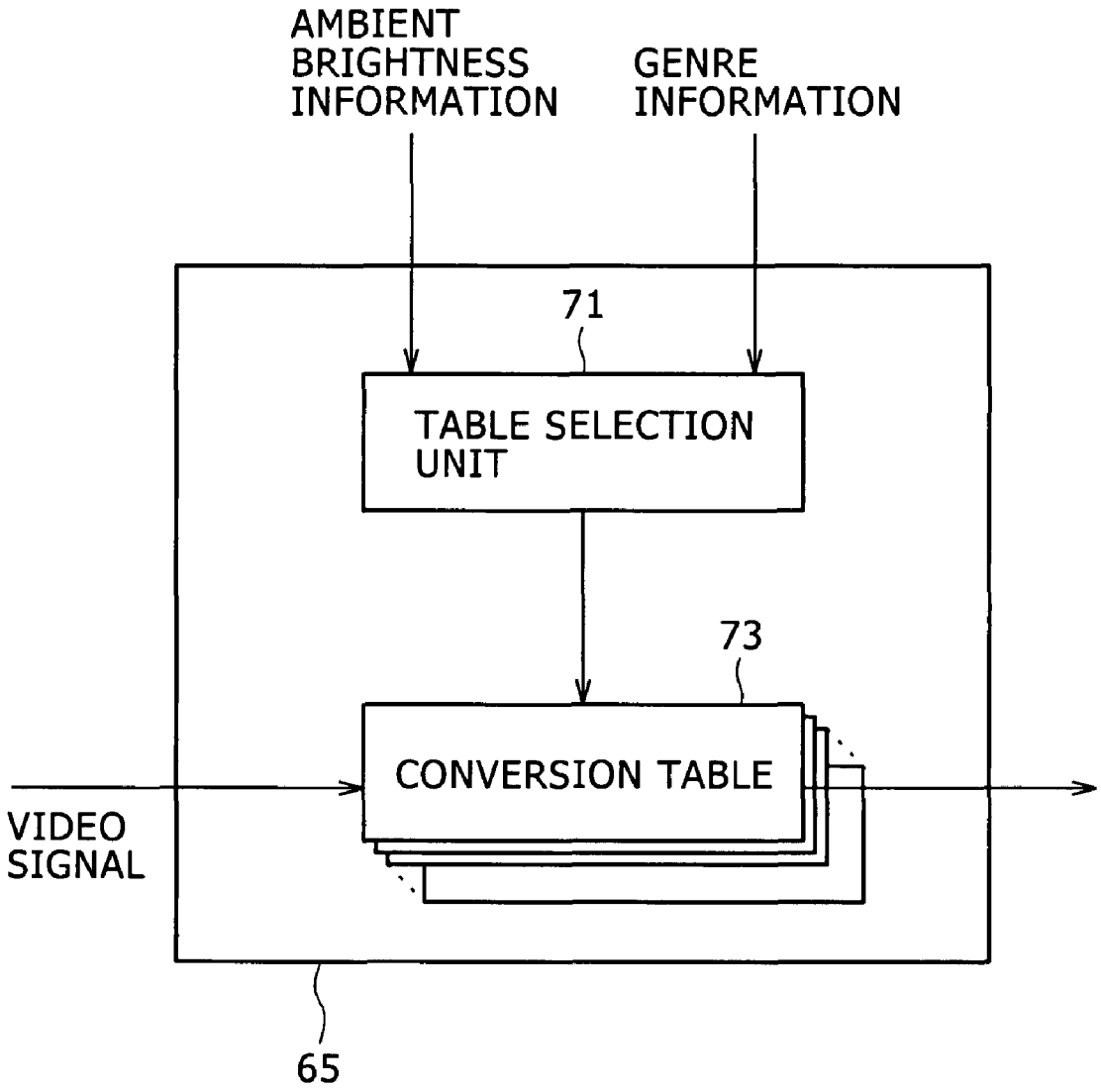
FIG. 16 is a view illustrating another example of internal configuration of the by-region gray level conversion unit.

FIG. 16 illustrates an example of internal configuration of the by-region gray level conversion unit 65. The by-region gray level conversion unit 65 includes a table selection unit 71 and a conversion table 73.

The table selection unit 71 selects an optimal conversion table based on genre information if ambient brightness is high. The same unit 71 stops conversion (or selects a conversion table in which the input and output gray levels are the same) when ambient brightness is not high.

The conversion table 73 includes a plurality of sets of conversion tables prepared in advance on a genre information by genre information basis. Also in the case of the conversion table 73, to be exact, as many conversion tables as 256 gray levels should be prepared. Practically, however, a plurality of representative sets of tables are incorporated in consideration of the frequency of use and the rate of change in gray level after conversion. As a result, the table selection unit 73 selects a conversion table which contains a mean gray level specific to each genre within the estimated range.

The individual tables of the conversion table 73 are the same in structure as those of the conversion table 55 described in relation to the embodiment 2.

Figure 17:
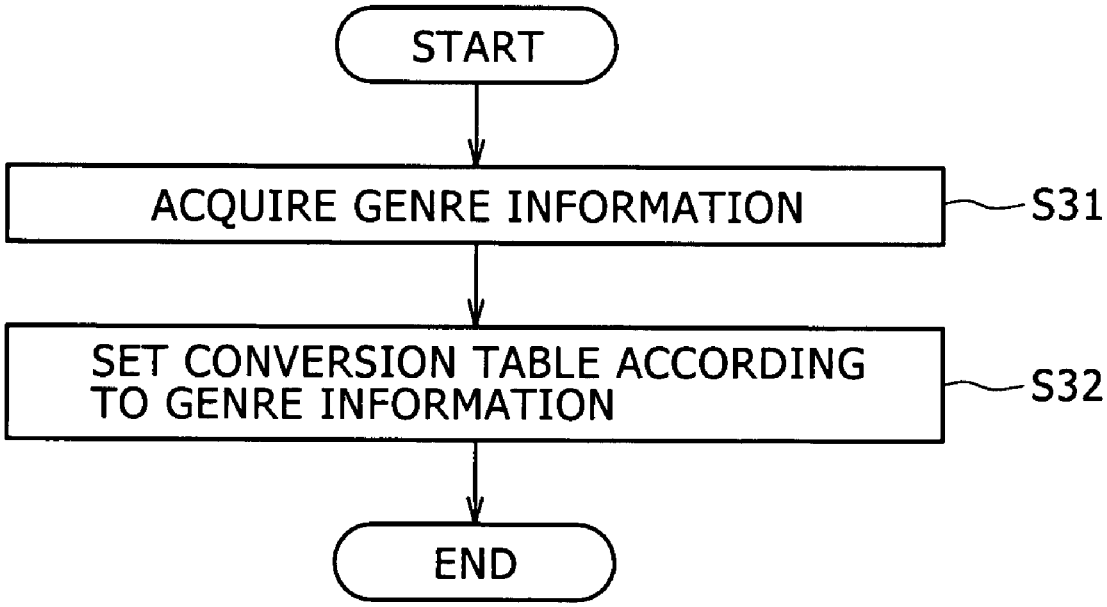
FIG. 17 is a view illustrating another example of conversion table setting procedure.

FIG. 17 illustrates the procedure for setting the conversion table. It should be noted that the operation steps illustrated in FIG. 17 are performed every frame.

In this case, the genre information acquisition unit 63 acquires genre information attached to the video signal (S31).

Next, the by-region gray level conversion unit 65 sets a conversion table with low, intermediate and high gray levels specified according to the mean gray level (S32).

From here onward, gray level conversion is performed continuously on a pixel-by-pixel basis using the selected conversion table.

Reference to genre information as in the present embodiment eliminates the need to calculate a mean gray level per frame, thus permitting gray level conversion suitable for input video signal.

As described above, one conversion table is used for each program in the method based on a reference to genre information.

Therefore, this prevents frequent switching of gray level conversion during a program, thus keeping the load on the signal processing system low.

It should be noted that the present embodiment may be combined with the arrangement based on reference to mean gray level described in the embodiment 2. In this case, if there is a large difference between a mean gray level of the entire program and that per frame, priority may be given to the gray level conversion based on the mean gray level calculated per frame.

(D) Embodiment 4

In the three embodiments described above, primary emphasis was placed on reduction of power consumption by gray level conversion performed for each gray level region.

However, reduced power consumption can be effectively used to actively provide improved visibility.

Figure 18:
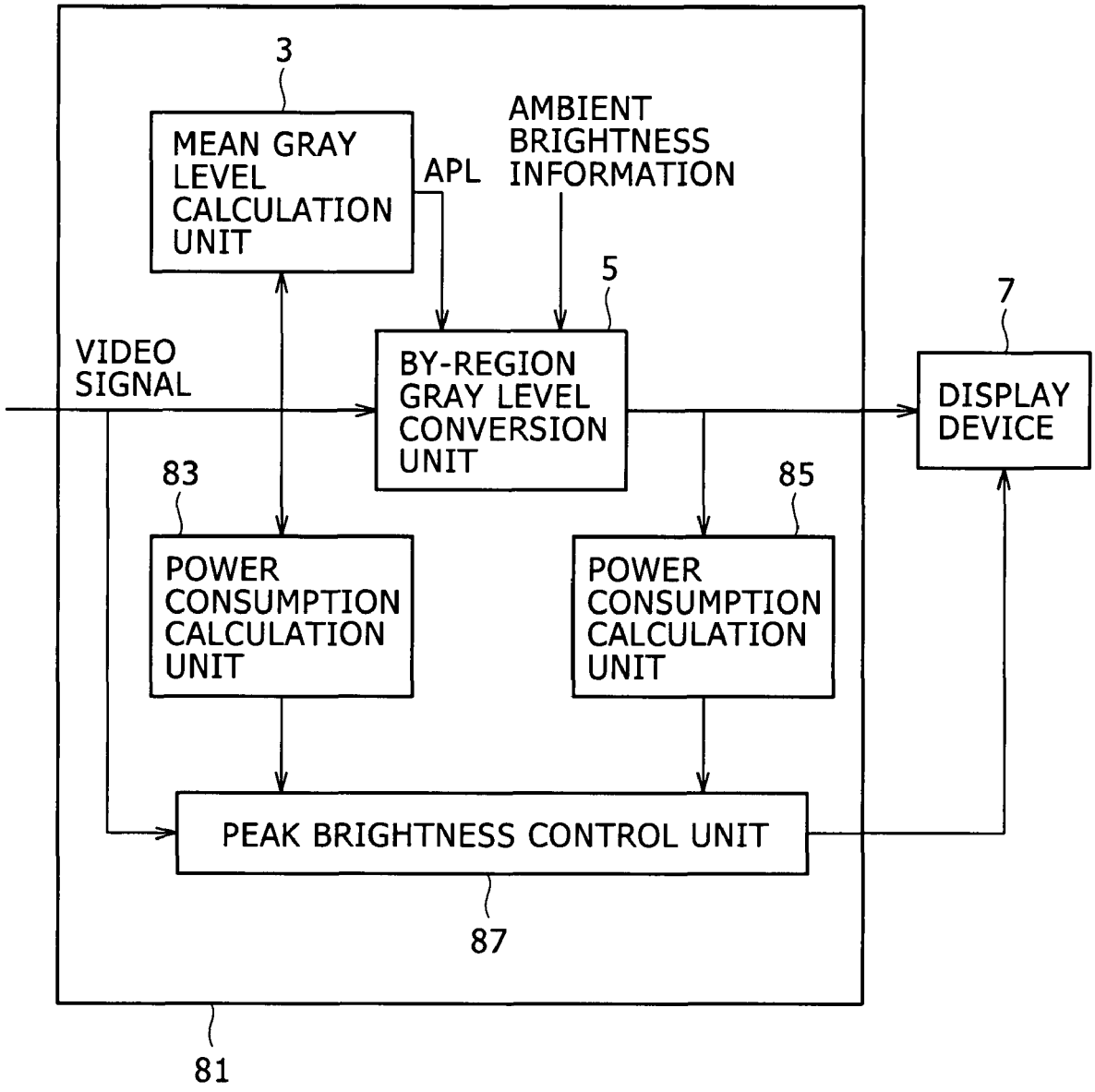
FIG. 18 is a view illustrating an example of functional configuration of a visibility improvement device.

FIG. 18 illustrates an example of functional configuration of a visibility improvement device 81 of the type described above. It should be noted that the visibility improvement device 81 includes the power consumption reduction device 1 illustrated in FIG. 1 as a basic component thereof. In FIG. 18, therefore, like components as those in FIG. 1 are designated by the same numerals.

The visibility improvement device 81 includes the mean gray level calculation unit 3, the by-region gray level conversion unit 5, power consumption calculation units 83 and 85, and a peak brightness control unit 87. A description will be made below about the power consumption calculation units 83 and 85, and the peak brightness control unit 87.

The power consumption calculation unit 83 is a processing device operable to calculate power consumption prior to gray level conversion. On the other hand, the power consumption calculation unit 85 is a processing device operable to calculate power consumption following gray level conversion.

Figure 19:
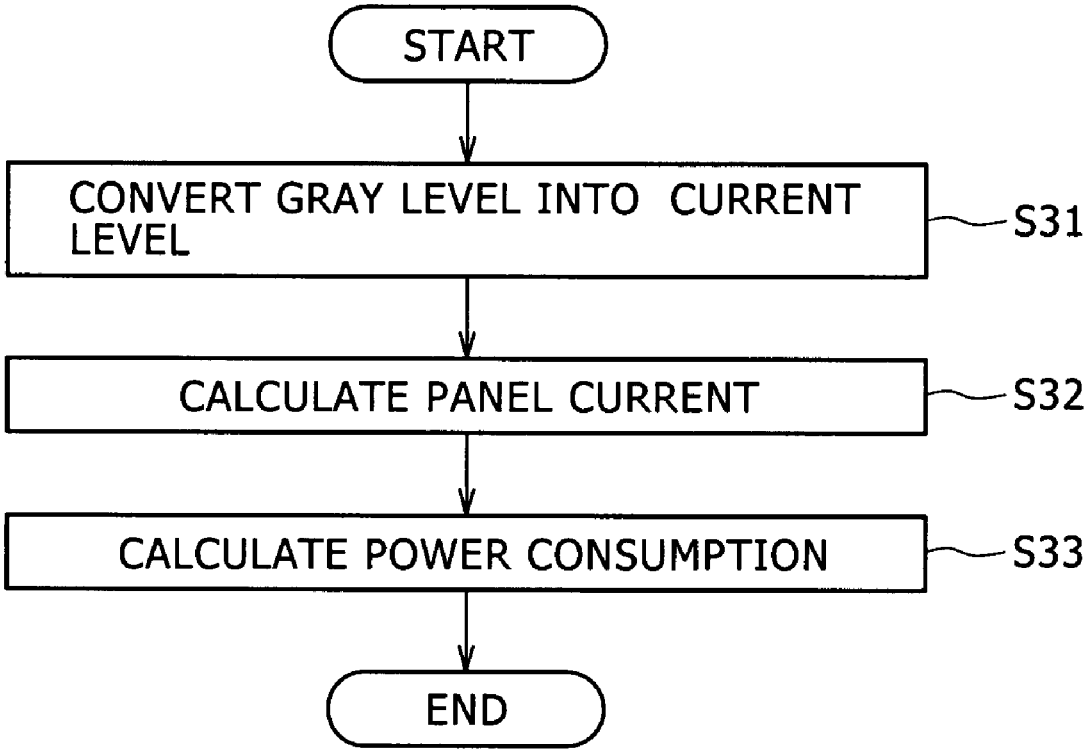
FIG. 19 is a view illustrating an example of power consumption calculation procedure.

FIG. 19 illustrates an example of process steps common to both the power consumption calculation units 83 and 85. In the power consumption calculation, the gray level for each pixel is converted into a current level first (S31).

Figure 20:
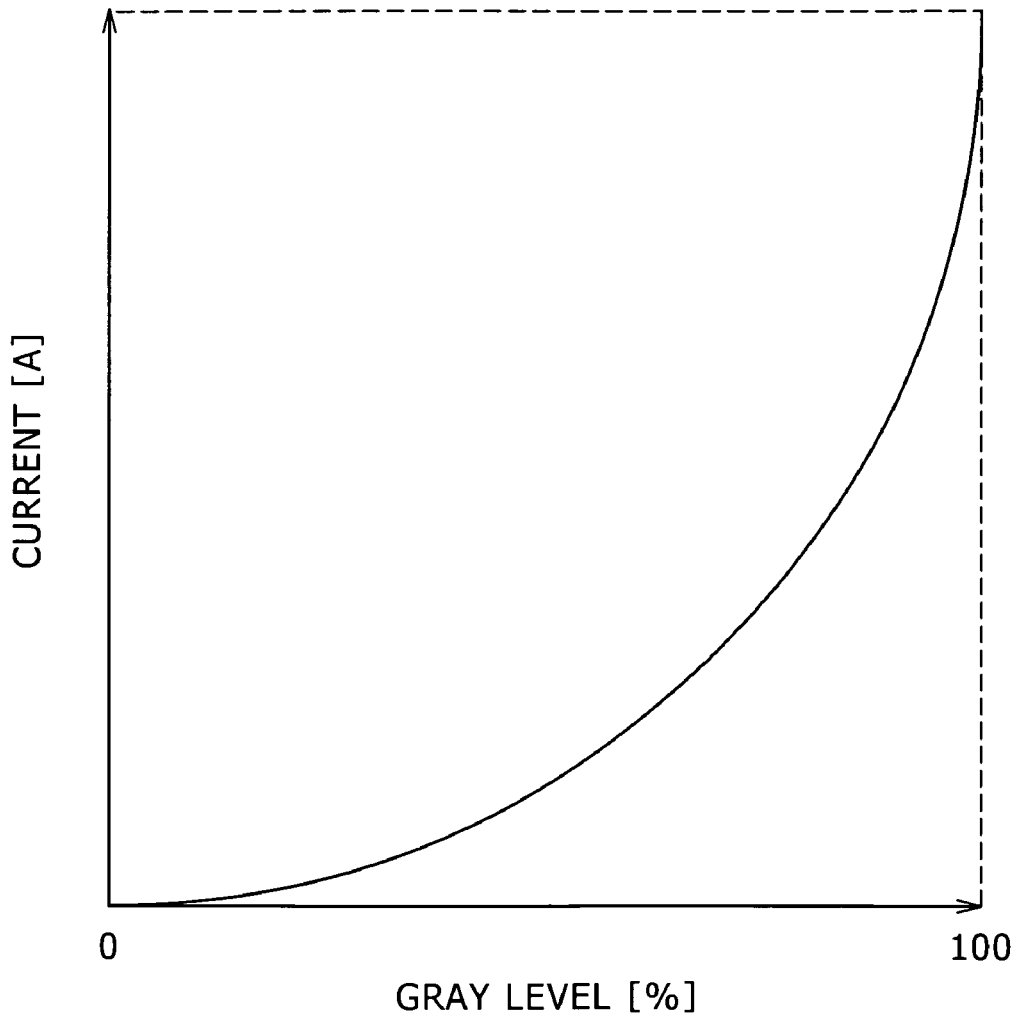
FIG. 20 is a characteristic curve illustrating the correspondence between a gray level and a current level.

In this conversion, a gray level-to-current level conversion table illustrated in FIG. 20 is referred to. As illustrated in FIG. 20, the current level has the property to increase non-linearly with respect to the gray level due to the gamma characteristic of the organic EL device. Therefore, the gray level is converted into an appropriate current level according to the correspondence registered in advance.

Next, the power consumption calculation units 83 and 85 calculate panel current consumption (sum of current consumptions of all pixels) in an entire one frame period (S32). This calculation is carried out over a period from one vertical synchronizing signal input to the next.

When the panel current level is obtained, the power consumption calculation units 83 and 85 each multiply the panel current level by the supply voltage level to calculate the power consumption (S33). The power consumption calculated by a series of the above steps is supplied to the peak brightness control unit 87 by each of the calculation units 83 and 85.

The peak brightness control unit 87 refers to the value, obtained by dividing the power consumption prior to gray level conversion by that following gray level conversion, as a peak brightness incremental factor. By doing so, the peak brightness control unit 87 controls the peak brightness of the display device 7 so that the incremental factor is satisfied. That is, the peak brightness control unit 87 controls the peak brightness so that the power consumption of the display device 7 is almost the same as prior to gray level conversion.

Figures 21A, 21B:
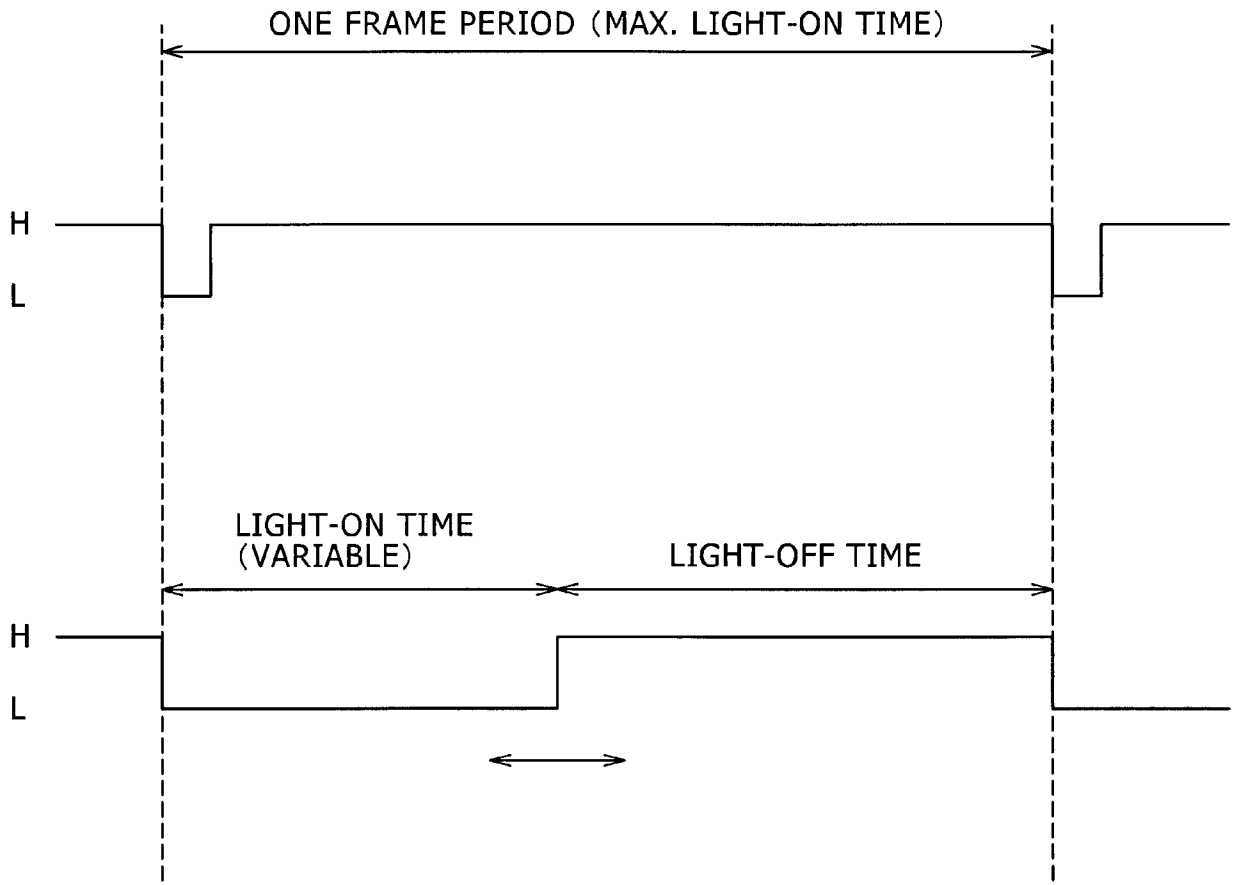
FIGS. 21A and 21B are views explaining duty pulse signal variation control.
Figure 22:
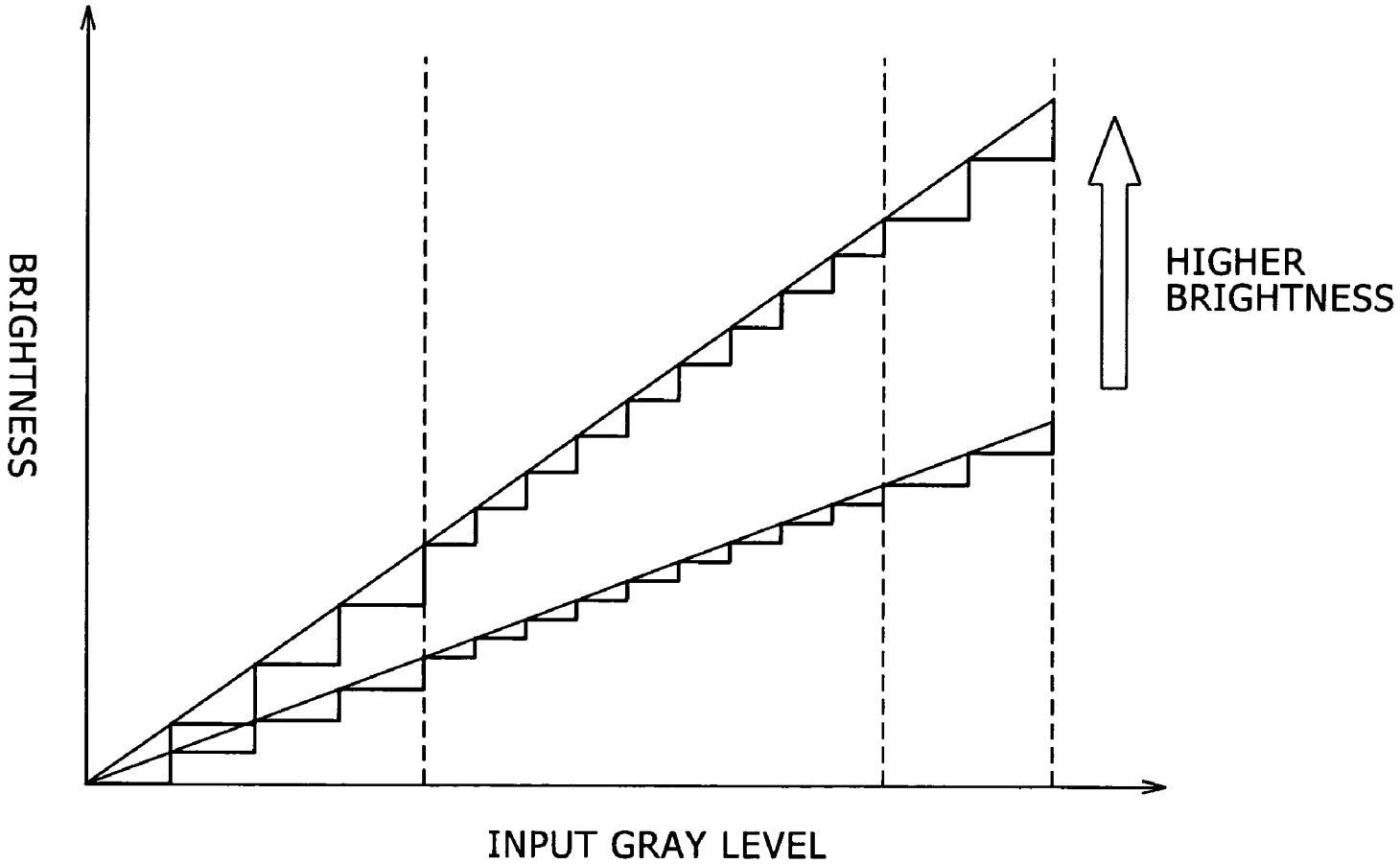
FIG. 22 is a view explaining change in peak brightness as a result of duty pulse signal control.

In the present embodiment, the peak brightness control is accomplished by varying the low-level period of the duty pulse signal as illustrated in FIG. 21. The larger the proportion of the low-level period of the signal in a one-frame period, the longer the organic EL device is lit. Conversely, the smaller the proportion of the low-level period of the signal in a one-frame period, the shorter the organic EL device is lit.

That is, power consumption changes with change in the low-level period of the duty pulse signal. It should be noted that the peak brightness control unit 87 controls the output timing of the duty pulse signal in response to reception of a timing signal for video signal.

In the present embodiment, reduction in power consumption achieved by gray level conversion can be used to provide higher peak brightness. This permits highly visible display even in high ambient brightness conditions. The present embodiment provides a highly visible display screen despite the fact that power consumption remains the same as in the case where gray level conversion is not performed as described in the embodiment 1.

(D) Examples of Incorporation

Here, a description will be made about examples of incorporation of the aforementioned power consumption reduction device or visibility improvement device into electronic equipment. First, examples of incorporation of the power consumption reduction device into electronic equipment will be described.

(a) Incorporation into Self-Luminous Display Apparatus

Figure 23:
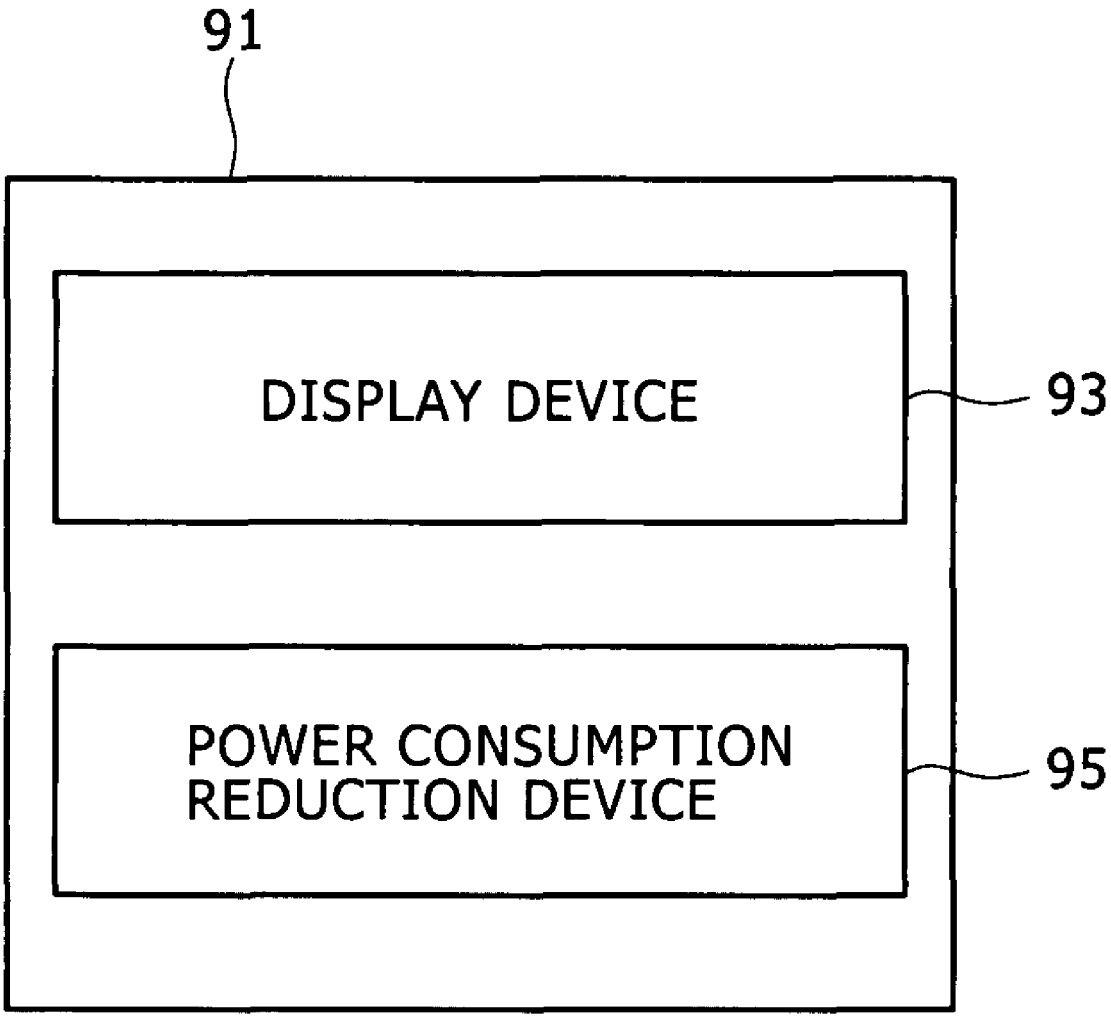
FIG. 23 is a view explaining an example of incorporation into electronic equipment.

The power consumption reduction device 1 can be incorporated into a self-luminous display apparatus 91 as illustrated in FIG. 23. A display device 93 and a power consumption reduction device 95 are incorporated in the self-luminous display apparatus 91 illustrated in FIG. 23.

It should be noted that the power consumption reduction device 95 can be implemented by a small-scale circuit. Therefore, the same device 95 can be accommodated in an IC (integrated circuit) or other circuitry incorporated into the display device 93.

For example, if the display device 93 has a device configuration as described with reference to FIG. 6, the power consumption reduction device 95 can be incorporated in part of the timing generator 21 (FIG. 6).

As described above, if the power consumption reduction device 95 is incorporated in part of the existing processing circuit, there is no need to change the layout or incorporation space, thus making the embodiment advantageous in terms of manufacturing cost.

(b) Image Processing Device

The aforementioned power consumption reduction device can also be incorporated in an image processing device 111. The image processing device 111 is provided as an external device to supply a video signal to a self-luminous display device 101 as illustrated in FIG. 24.

Figure 24:
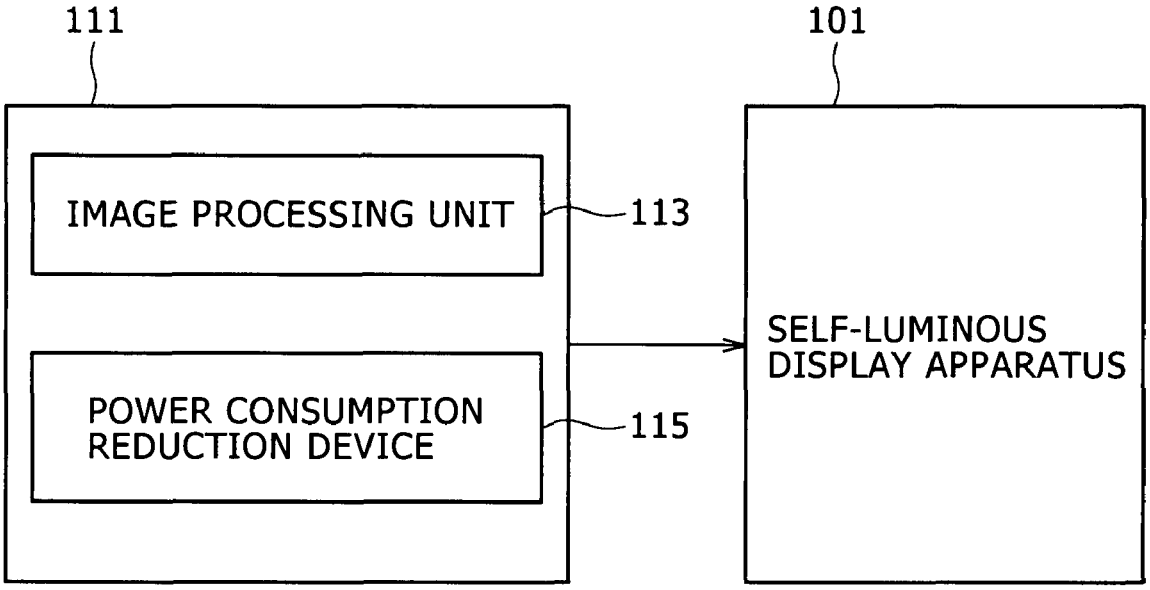
FIG. 24 is a view explaining another example of incorporation into electronic equipment.

FIG. 24 illustrates a case where the image processing device 111 is directly connected to the self-luminous display device 101. However, the image processing device 111 is also applicable when it is connected to the self-luminous display device 101 via the Internet or other network.

The image processing device 111 illustrated in FIG. 24 includes an image processing unit 113 and a power consumption reduction device 115. It should be noted that the details of the process performed by the image processing unit 113 depend upon the application installed.

(c) Other Examples of Incorporation

The power consumption reduction and visibility improvement devices may be incorporated in a variety of electronic equipment in addition to the apparatus described earlier. It should be noted that although incorporation is possible irrespective of whether electronic equipment is portable or stationary, there should be, as a precondition, at least a likelihood that the display device may be used in high ambient brightness conditions.

(c1) Broadcast Wave Reception Apparatus

The power consumption reduction device may be incorporated in a broadcast wave reception apparatus.

Figure 25:
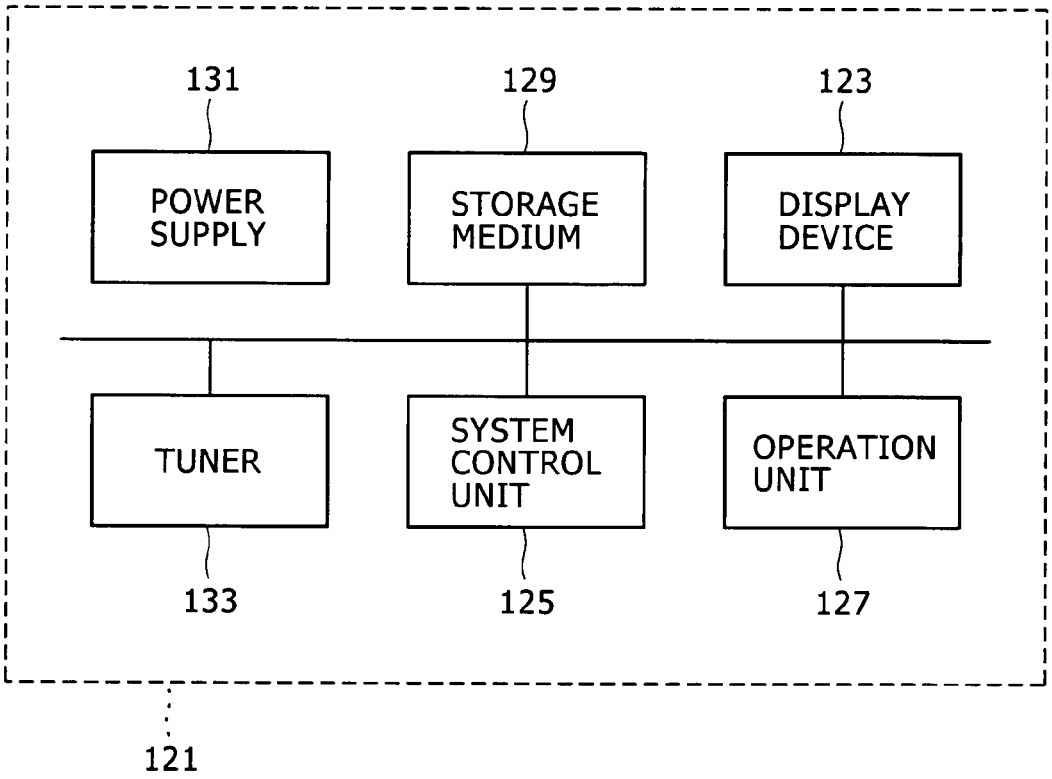
FIG. 25 is a view explaining an example of the power consumption reduction device incorporated in electronic equipment.

FIG. 25 illustrates an example of functional configuration of a broadcast wave reception apparatus. A broadcast wave reception apparatus 121 includes a display device 123, a system control unit 125, an operation unit 127, a storage medium 129, a power supply 131 and a tuner 133 as its major components.

It should be noted that the system control unit 125 includes, for example, a microprocessor. The system control unit 125 controls the overall operation of the system. The operation unit 127 includes not only mechanical controls but also a graphic user interface.

The storage medium 129 is used as a storage area of not only data for images and video to be displayed on the display device 123 but also firmware and application programs. A battery power supply is used as the power supply 131 when the broadcast wave reception apparatus 121 is portable. Needless to say, a commercial power supply is used when the broadcast wave reception apparatus 121 is stationary.

The tuner 133 selectively receives the wave of the channel selected by the user from among incoming broadcast waves.

The configuration of this broadcast wave reception apparatus is applicable, for example, to television program receivers, radio program receivers and electronic equipment incorporating the broadcast wave reception function.

(c2) Audio Apparatus

Figure 26:
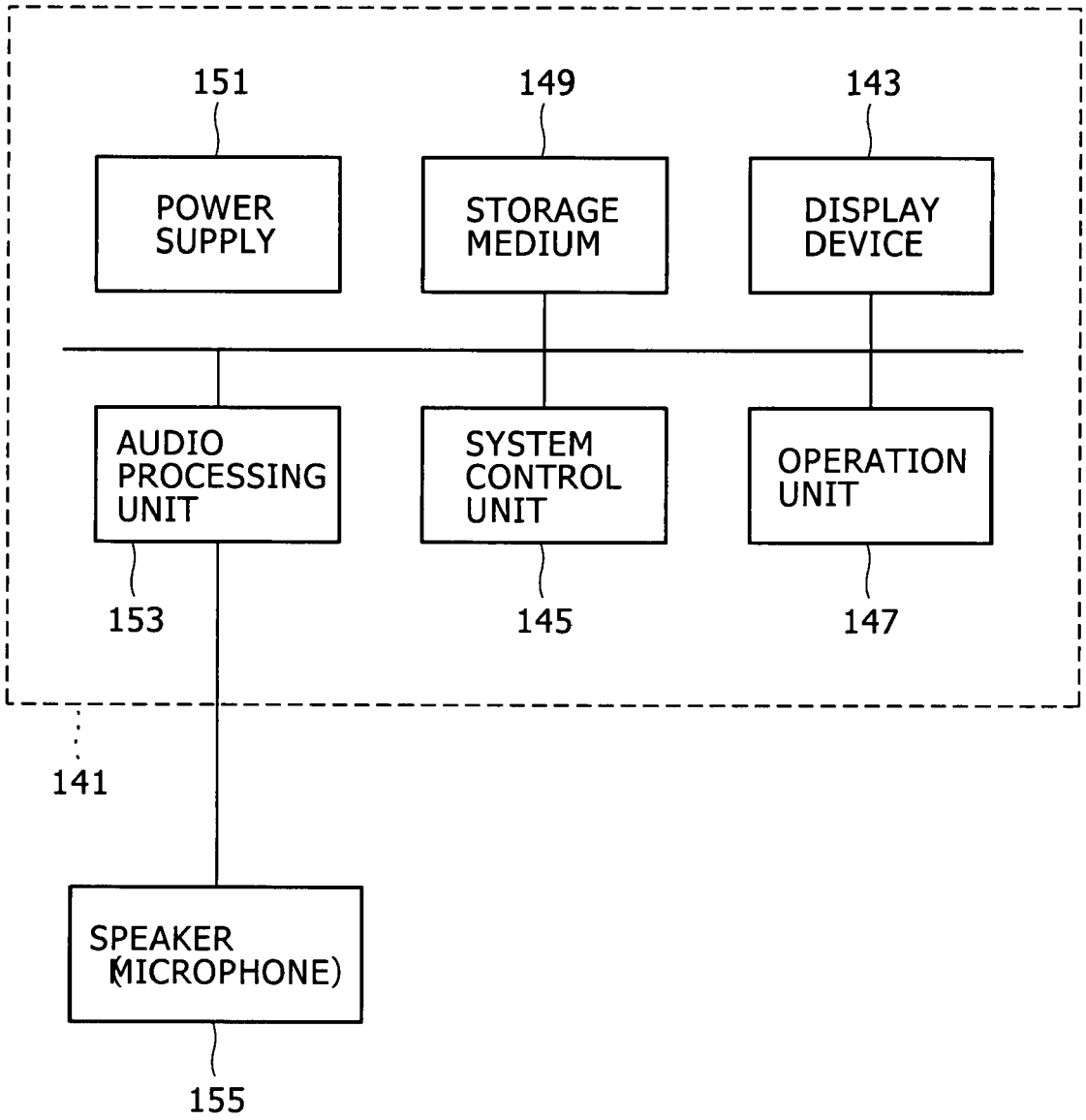
FIG. 26 is a view explaining another example of the power consumption reduction device incorporated in electronic equipment.

FIG. 26 illustrates an example of functional configuration of an audio apparatus serving as a player when the power consumption reduction device is applied.

An audio apparatus 141 serving as a player includes a display device 143, a system control unit 145, an operation unit 147, a storage medium 149, a power supply 151, an audio processing unit 153 and a speaker 155 as its major components.

Also in this case, the system control unit 145 includes, for example, a microprocessor. The same unit 145 controls the overall operation of the system. The operation unit 147 includes a graphic user interface as well as mechanical controls.

The storage medium 149 serves as a storage area of firmware and application programs as well as audio data. The storage medium 149 is also used to store music data. A semiconductor storage medium, hard disk drive or other medium is used as the storage medium 149.

A battery power supply is used as the power supply 151 when the audio apparatus 141 is portable. Naturally, a commercial power supply is used when the audio apparatus 141 is stationary.

The audio processing unit 153 is a processing device operable to process an audio data signal. The same unit 153 decompresses compressed and coded audio data. The speaker 155 outputs reproduced sounds.

It should be noted that if the audio apparatus 141 is used as a recorder, a microphone is connected in place of the speaker 155. In this case, the audio processing unit 153 is capable of compressing and coding audio data.

The configuration of this audio apparatus is applicable, for example, to portable musical equipment and mobile phones.

(c3) Communication Apparatus

Figure 27:
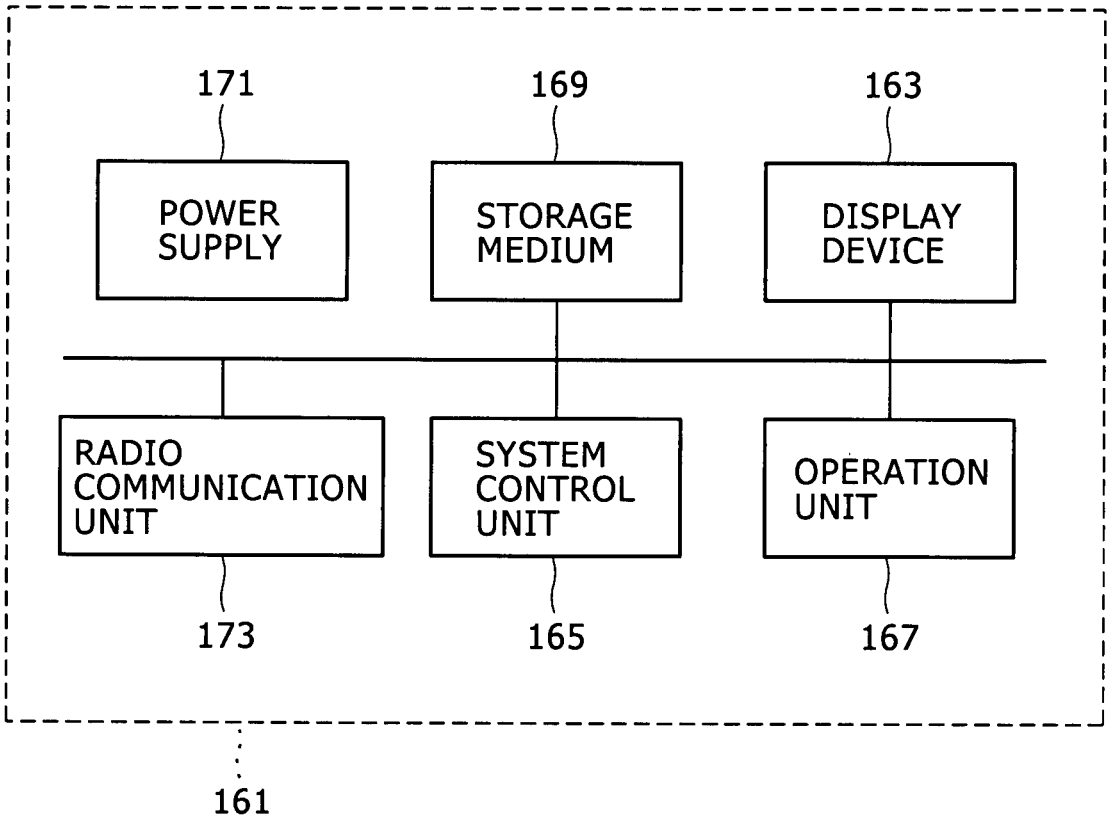
FIG. 27 is a view explaining still another example of the power consumption reduction device incorporated in electronic equipment.

FIG. 27 illustrates an example of functional configuration of a communication apparatus when the power consumption reduction device is applied. A communication apparatus 161 includes a display device 163, a system control unit 165, an operation unit 167, a storage medium 169, a power supply 171 and a communication unit 173 as its major components.

It should be noted that the system control unit 165 includes, for example, a microprocessor. The same unit 165 controls the overall operation of the system. The operation unit 167 includes a graphic user interface as well as mechanical controls.

The storage medium 169 is used as a storage area of firmware and application programs as well as data files for images and video to be displayed on the display device 163. A battery power supply is used as the power supply 171 when the communication apparatus 161 is portable. Naturally, a commercial power supply is used when the communication apparatus 161 is stationary.

The communication unit 173 is a radio device operable to exchange data with external equipment. The configuration of this communication apparatus is applicable, for example, to stationary telephone sets, mobile phones and portable electronic equipment incorporating the communication function.

(c4) Image Pickup Apparatus

Figure 28:
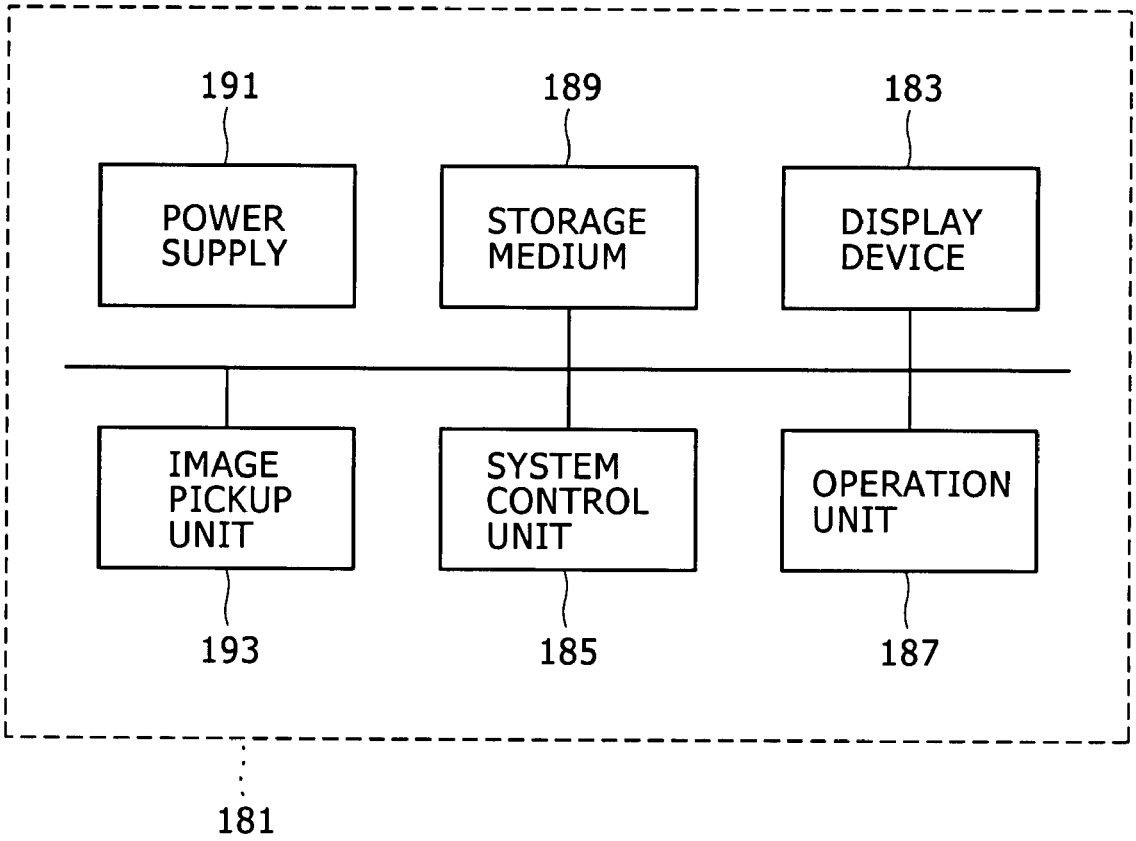
FIG. 28 is a view explaining still another example of the power consumption reduction device incorporated in electronic equipment.

FIG. 28 illustrates an example of functional configuration of an image pickup apparatus when the power consumption reduction device is applied. An image pickup apparatus 181 includes a display device 183, a system control unit 185, an operation unit 187, a storage medium 189, a power supply 191 and an image pickup unit 193 as its major components.

It should be noted that the system control unit 185 includes, for example, a microprocessor. The same unit 185 controls the overall operation of the system. The operation unit 187 includes a graphic user interface as well as mechanical controls.

The storage medium 189 is used as a storage area of firmware and application programs as well as data files for images and video to be displayed on the display device 183. A battery power supply is used as the power supply 191 when the image pickup apparatus 181 is portable. Naturally, a commercial power supply is used when the image pickup apparatus 181 is stationary.

The image pickup unit 193 includes, for example, a CMOS sensor and a signal processing unit operable to process an output signal from the CMOS sensor. The configuration of this image pickup apparatus is applicable, for example, to digital cameras, video camcorders and portable electronic equipment incorporating the image pickup function.

(c5) Information Processing Apparatus

Figure 29:
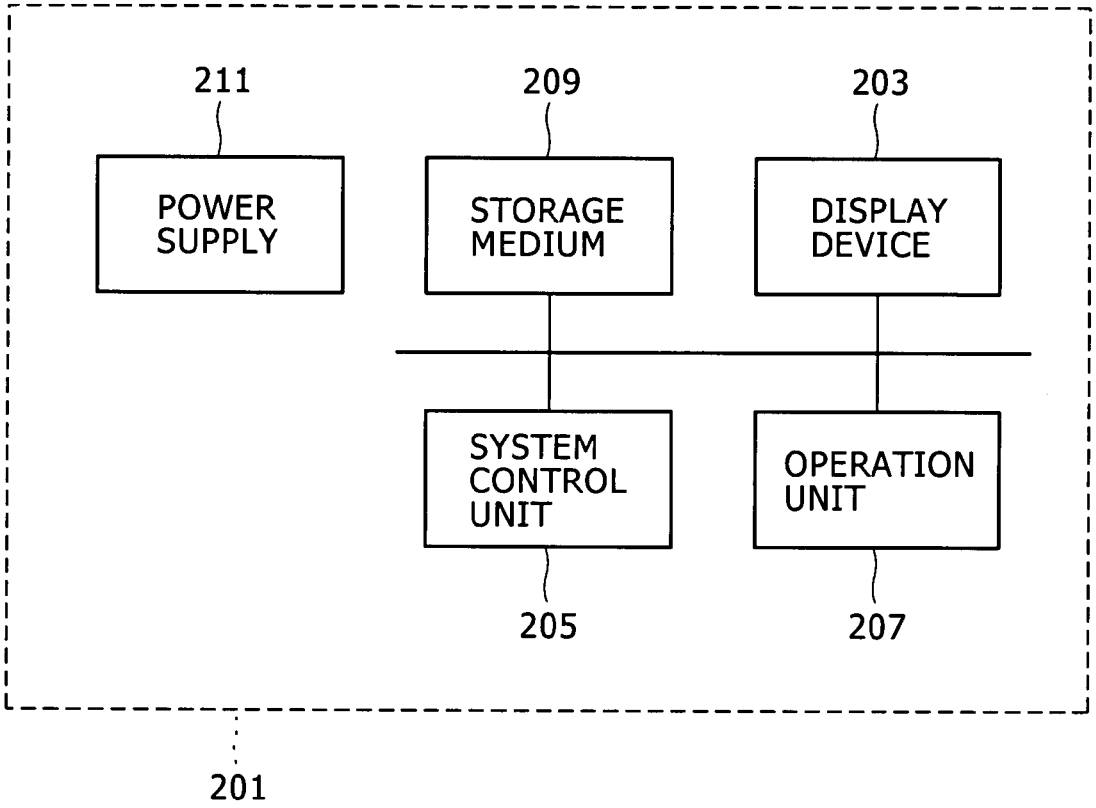
FIG. 29 is a view explaining still another example of the power consumption reduction device incorporated in electronic equipment.
Figure 30A:
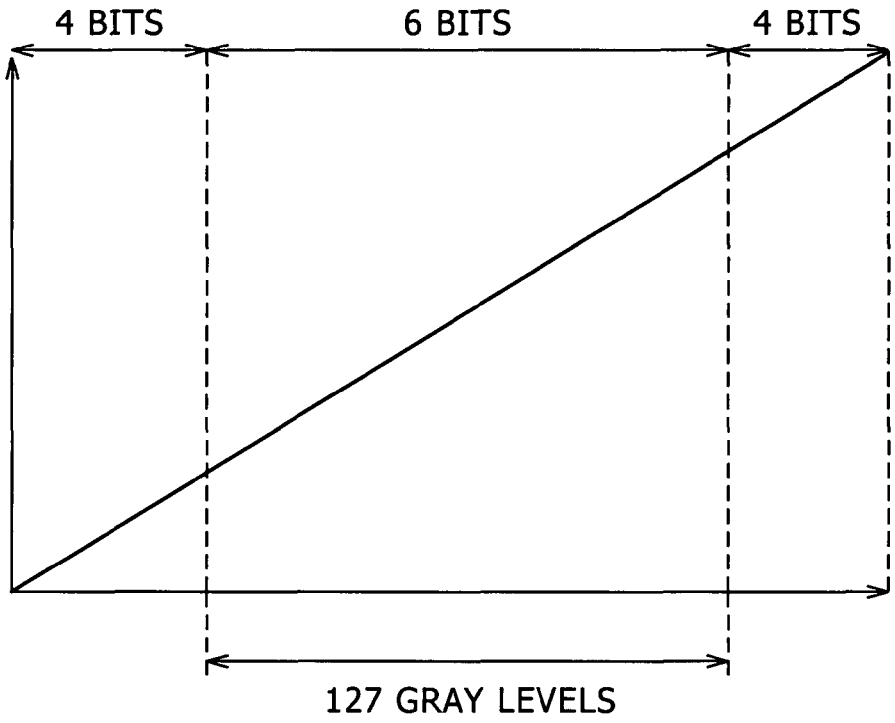
FIGS. 30A and 30B are views illustrating other examples of setting gray level regions.
Figure 30B:
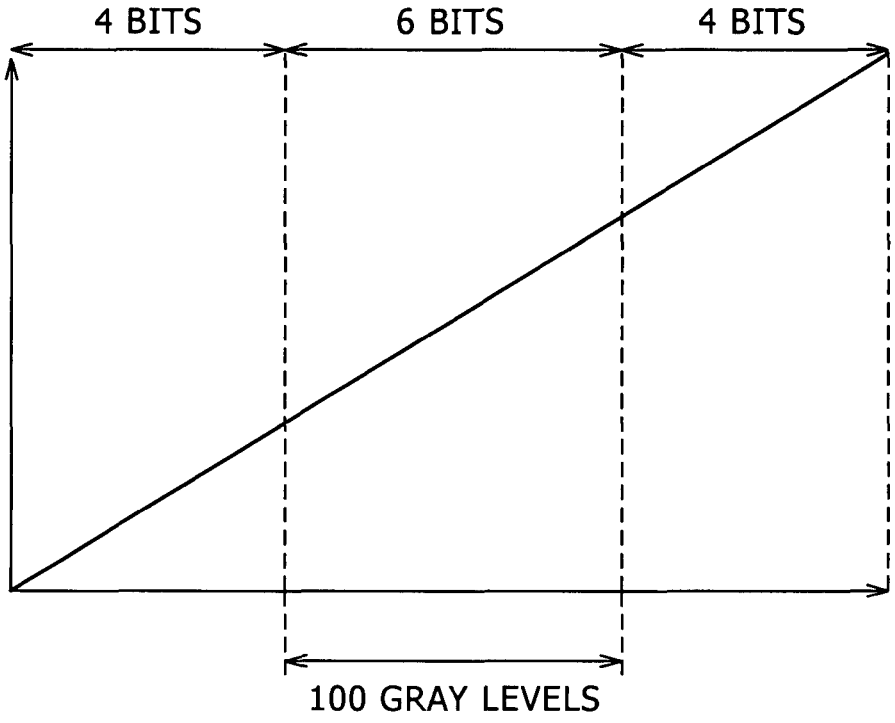

FIG. 29 illustrates an example of functional configuration of a portable information processing apparatus when the power consumption reduction device is applied. An information processing apparatus 201 includes a display device 203, a system control unit 205, an operation unit 207, a storage medium 209 and a power supply 211 as its major components.

It should be noted that the system control unit 205 includes, for example, a microprocessor. The same unit 205 controls the overall operation of the system. The operation unit 207 includes a graphic user interface as well as mechanical controls.

The storage medium 209 is used as a storage area of firmware and application programs as well as data files for images and video to be displayed on the display device 203. A battery power supply is used as the power supply 211 when the information processing apparatus 201 is portable. Naturally, a commercial power supply is used when the information processing apparatus 201 is stationary.

The configuration of this information processing apparatus is applicable, for example, to game machines, electronic books, electronic dictionaries, computers and measuring instruments. It should be noted that if the configuration thereof is applied to a measuring instrument, a detection signal from the sensor (detection device) is fed to the system control unit 205.

(E) Other Embodiments (a) In the aforementioned embodiments, a description was made about a case where ambient brightness information is fed via an ambient light sensor.

However, ambient brightness information may be given through manipulation of the user interface as a signal adapted to switch between processes. In this case, power consumption reduction or visibility improvement operation is performed at the discretion of the user.

(b) In the aforementioned embodiments, a description was made about a case where an eight-bit video signal is given. However, a video signal having other bit count may be given. For example, a 10- or 12-bit video signal may be given.

(c) In the aforementioned embodiments, a description was made about a case where 128 gray levels are assigned to the intermediate gray level region. However, the number of gray levels assigned to the intermediate gray level region is arbitrary. For example, a fewer number of gray levels such as 100, or a larger number of gray levels such as 150, may be assigned.

(d) In the aforementioned embodiments, a description was made about a case where the low gray level region is converted into 16 gray levels (four bits), the intermediate gray level region into 64 gray levels (six bits), and the high gray level region into 16 gray levels (four bits).

Figure 31A:
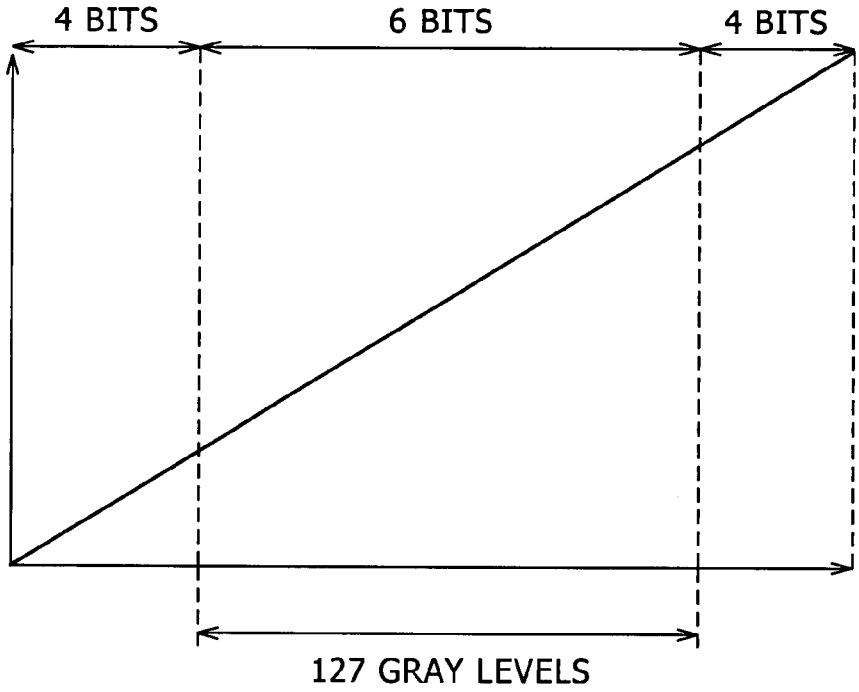
FIGS. 31A and 31B are views illustrating other examples of assigning gray level information to gray level regions.
Figure 31B:
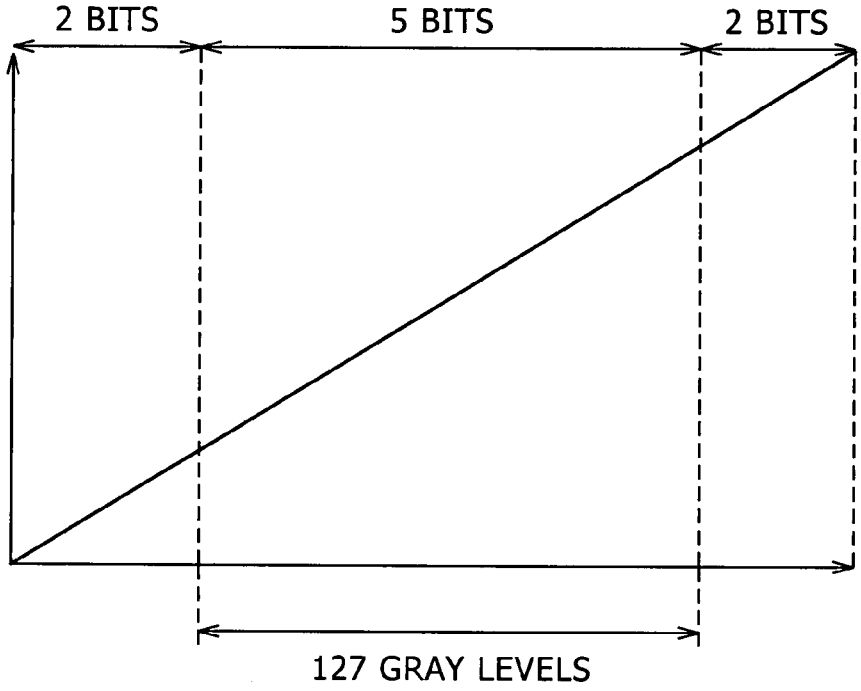

However, the amount of gray level information assigned to each gray level region is arbitrary. For example, the low gray level region may be converted into four gray levels (two bits), the intermediate gray level region into 32 gray levels (five bits), and the high gray level region into four gray levels (two bits) as illustrated in FIGS. 31A and 31B. This provides further reduced power consumption.

(e) In the aforementioned embodiments, a description was made about a case where output gray level information is reduced as compared to input gray level information for all gray level regions.

Figure 32:
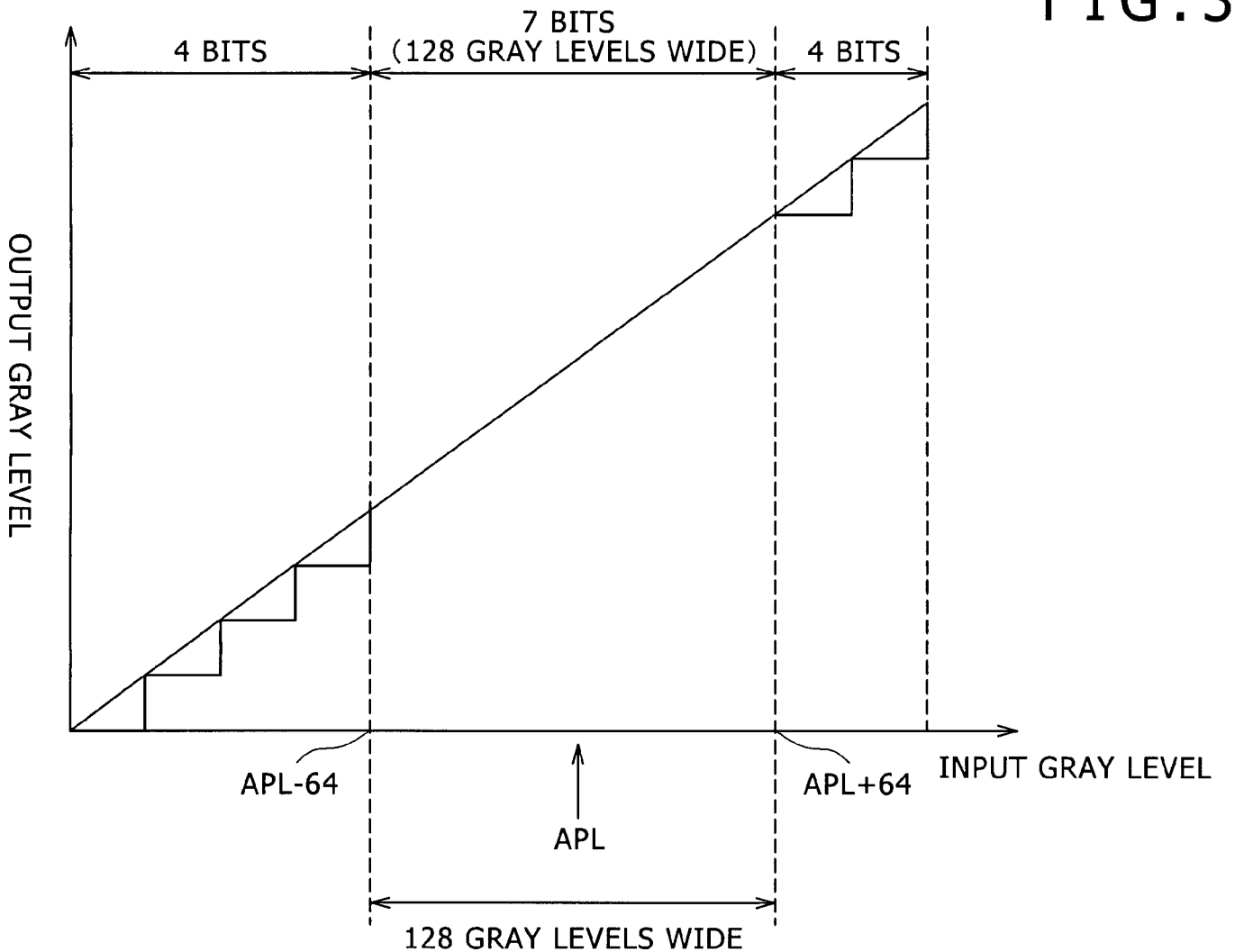
FIG. 32 is a view illustrating another example of assigning gray level information to gray level regions.

As illustrated in FIG. 32, however, output gray level information may be reduced as compared to input gray level information for the low and high gray level regions, with input gray level information preserved as is for the intermediate gray level region.

The embodiment illustrated in FIG. 32 preserves as much of the gray level information as possible for the intermediate gray level while at the same time providing reduced power consumption as compared to the embodiment 1. Nevertheless, in high ambient brightness conditions, part of the gray level information for the intermediate gray level region is also corrupted. Therefore, the preserved gray level information will not necessarily translate into improved visibility.

(f) In the aforementioned embodiments, a description was made about a case where the peak brightness level is controlled by controlling the low-level period of the duty pulse signal.

Figure 33:
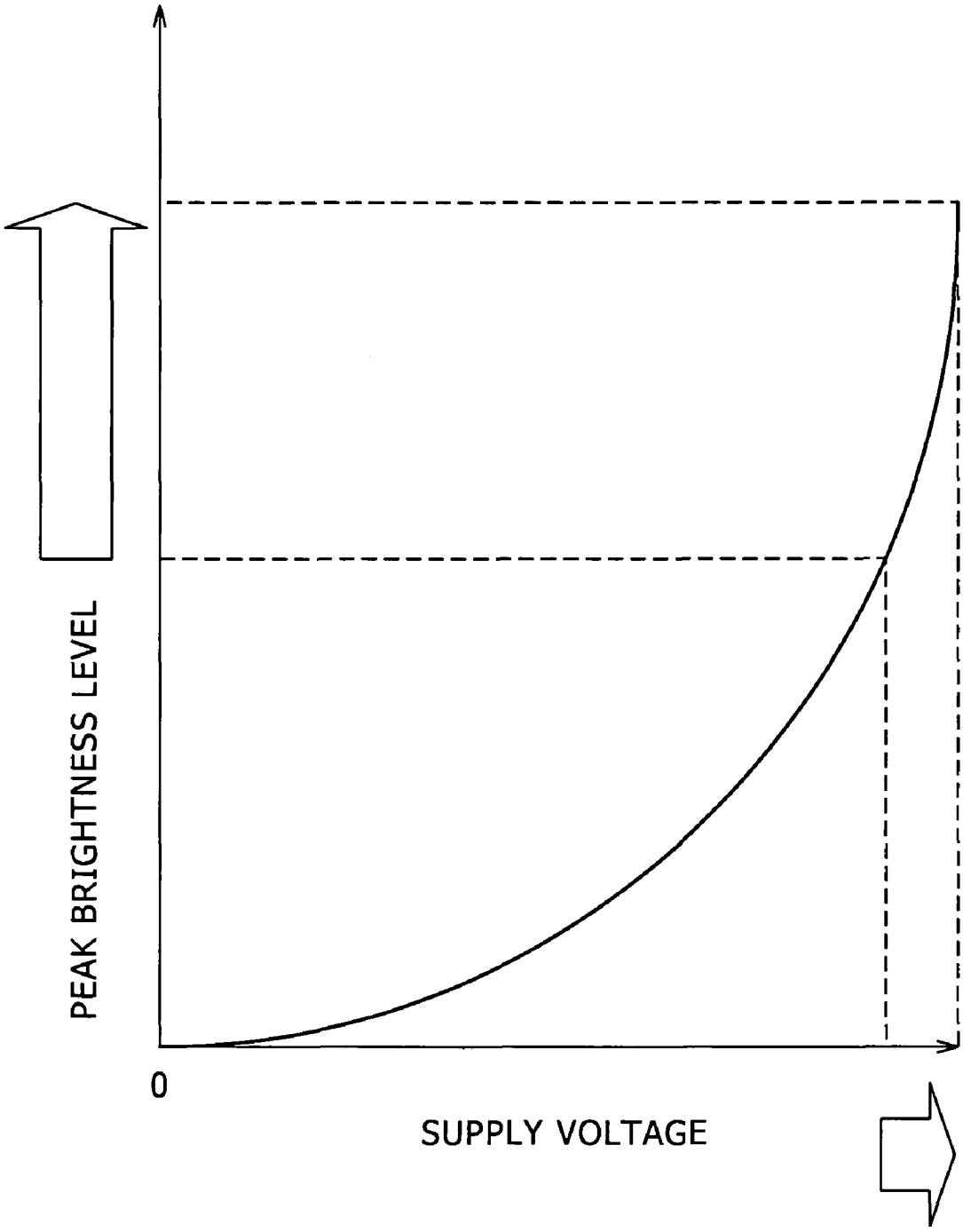
FIG. 33 is a view explaining change in peak brightness level as a result of supply voltage control.

However, the peak brightness level control can also be accomplished by controlling the supply voltage level applied to the display device, as illustrated in FIG. 33. The peak brightness level has the property to increase non-linearly with increase in supply voltage as illustrated in the same figure.

Figure 34:
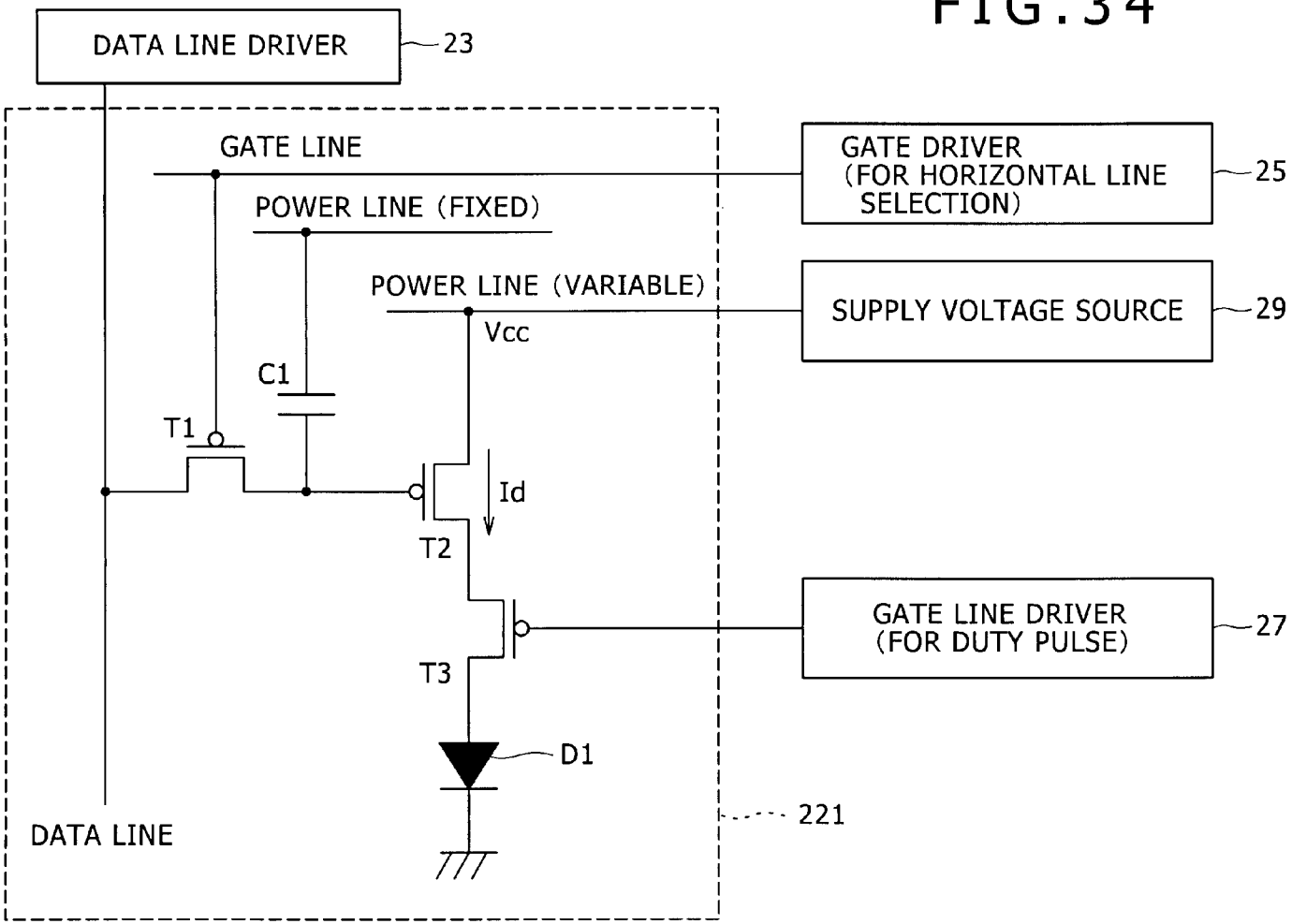
FIG. 34 is a view illustrating the connection relationship between the pixel circuit and peripheral circuits.

FIG. 34 illustrates an example of circuit configuration of a pixel circuit 221 capable of controlling the peak brightness by varying the supply voltage.

This pixel circuit is basically identical in circuit configuration to that of the embodiment 1 (FIG. 8). It should be noted that the pixel circuit in FIG. 34 differs from that in the embodiment 1 in that two separate power lines are provided, a variable one adapted to supply a potential to the anode of an organic EL device D1, and the other a fixed one for a capacitor C1. This makes it possible to vary the current level supplied to the organic EL device D1 even if the charge (gray level) stored in the capacitor C1 remains unchanged.

(g) In the aforementioned embodiments, a description was made about a case where the duty pulse signal is output once per frame (FIGS. 7 and 21).

Figures 35A, 35B:
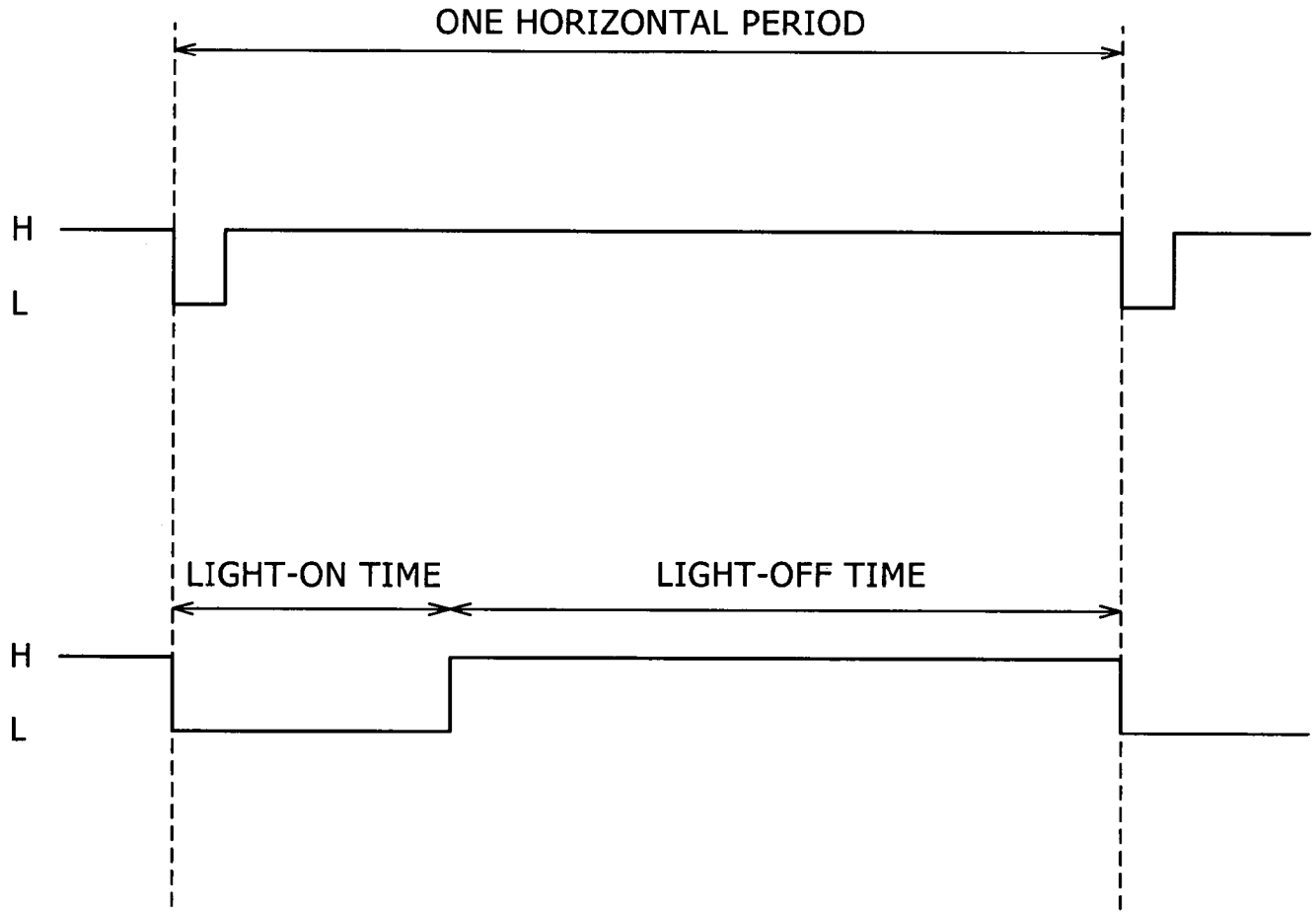
FIGS. 35A and 35B are views explaining other examples of setting the duty pulse signal.

As illustrated in FIG. 35, however, the duty pulse signal may be output once per horizontal period.

(h) In the aforementioned embodiments, a description was made about a case where an organic EL display panel is used as the display device.

However, other self-luminous display devices may be used instead as the display device.

For example, an inorganic EL, FED or PDP display apparatus may be used.

(i) The entire processing functionality of both the power consumption reduction and visibility improvement devices described in the aforementioned embodiments can be implemented in hardware or software form. Further, the entire processing functionality thereof can be implemented by using hardware and software in combination so that a share of the functionality is assigned to hardware and software.

(j) The aforementioned embodiments can be modified in various manners within the scope of the spirit of the invention. Further, various modifications and applications created or combined based on the description herein are also possible.

It should be understood by those skilled in the art that various modifications, combinations, sub-combinations and alterations may occur depending on design requirements and other factor in so far as they are within the scope of the appended claims or the equivalents thereof.

What is claimed is:

1. A power consumption reduction device comprising:

a region-adaptive gray level conversion unit;

wherein the gray level conversion unit is operable to convert n1 bits of gray level information for a low gray level region into m1 (<n1) bits of gray level information, further operable to convert n2 bits of gray level information for an intermediate gray level region into m2 (≦n2) bits of gray level information, and still further operable to convert n3 bits of gray level information for a high gray level region into m3 (<n3) bits of gray level information, and the gray level conversion unit converts a gray level of an input video signal so that m1≦m2, m3≦m2 and n1+n2+n3>m1+m2+m3 are all satisfied;

a first power consumption calculation unit operable to calculate power consumption for an input video signal prior to gray level conversion;

a second power consumption calculation unit operable to calculate power consumption for an input video signal following gray level conversion; and a peak brightness control unit operable to issue an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion.

2. The power consumption reduction device of claim 1 comprising:

a mean gray level calculation unit operable to calculate a mean gray level of an input video signal; and a gray level region setting unit operable to set the intermediate gray level region using the calculated mean gray level as an intermediate value.

3. The power consumption reduction device of claim 2, wherein the gray level region setting unit sets a boundary gray level between the low and intermediate gray level regions based on a level obtained by subtracting a gray level equivalent to half of n2 bits from a mean gray level, and the gray level region setting unit sets a boundary gray level between the intermediate and high gray level regions based on a level obtained by adding a gray level equivalent to half of n2 bits to a mean gray level.

4. The power consumption reduction device of claim 1, wherein the intermediate gray level region is set to half the number of gray levels reproducible from an input video signal.

5. The power consumption reduction device of claim 1, wherein the low, intermediate and high gray level regions are set based on genre information of an input video signal.

6. The power consumption reduction device of claim 1, wherein the gray level conversion unit performs gray level conversion by arithmetic operation.

7. The power consumption reduction device of claim 1, wherein the gray level conversion unit performs gray level conversion by referring to a conversion table.

8. The power consumption reduction device of claim 7, wherein the gray level conversion unit selects a conversion table to be referred to based on a mean gray level calculated for an input video signal.

9. The power consumption reduction device of claim 7, wherein the gray level conversion unit selects a conversion table to be referred to based on genre information of an input video signal.

10. A visibility improvement device comprising:

a region-adaptive gray level conversion unit operable to convert n1 bits of gray level information for a low gray level region into m1 (<n1) bits of gray level information, further operable to convert n2 bits of gray level information for an intermediate gray level region into m2 (≦n2) bits of gray level information, still further operable to convert n3 bits of gray level information for a high gray level region into m3 (<n3) bits of gray level information, and still further operable to convert a gray level of an input video signal so that m1≦m2, m3≦m2 and n1+n2+n3>m1+m2+m3 are all satisfied;

a first power consumption calculation unit operable to calculate power consumption for an input video signal prior to gray level conversion;

a second power consumption calculation unit operable to calculate power consumption for an input video signal following gray level conversion; and a peak brightness control unit operable to issue an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion.

11. The visibility improvement device of claim 10, wherein the peak brightness control unit controls the peak brightness level by controlling the length of a duty pulse which determines the length of light-on time within a frame period of a self-luminous display device.

12. The visibility improvement device of claim 10, wherein the peak brightness control unit controls the peak brightness level by controlling a supply voltage which gives the maximum gray level of a self-luminous display device.

13. A self-luminous display device comprising:

a region-adaptive gray level conversion unit operable to convert n1 bits of gray level information for a low gray level region into m1 (<n1) bits of gray level information, further operable to convert n2 bits of gray level information for an intermediate gray level region into m2 (≦n2) bits of gray level information, still further operable to convert n3 bits of gray level information for a high gray level region into m3 (<n3) bits of gray level information, and still further operable to convert a gray level of an input video signal so that m1≦m2, m3≦m2 and n1+n2+n3>m1+m2+m3 are all satisfied;

a first power consumption calculation unit operable to calculate power consumption for an input video signal prior to gray level conversion;

a second power consumption calculation unit operable to calculate power consumption for an input video signal following gray level conversion;

a peak brightness control unit operable to issue an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion; and a display device operable to display, on a screen, an image for an input video signal following gray level conversion.

14. An image processing device comprising:

a region-adaptive gray level conversion unit; wherein the gray level conversion unit is operable to convert n1 bits of gray level information for a low gray level region into m1 (<n1) bits of gray level information, further operable to convert n2 bits of gray level information for an intermediate gray level region into m2 (≦n2) bits of gray level information, and still further operable to convert n3 bits of gray level information for a high gray level region into m3 (<n3) bits of gray level information, and the gray level conversion unit converts a gray level of an input video signal so that m1≦m2, m3≦m2 and n1+n2+n3>m1+m2+m3 are all satisfied;

a first power consumption calculation unit operable to calculate power consumption for an input video signal prior to gray level conversion;

a second power consumption calculation unit operable to calculate power consumption for an input video signal following gray level conversion; and a peak brightness control unit operable to issue an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion.

15. An image processing device comprising:

a region-adaptive gray level conversion unit operable to convert n1 bits of gray level information for a low gray level region into m1 (<n1) bits of gray level information, further operable to convert n2 bits of gray level information for an intermediate gray level region into m2 (≦n2) bits of gray level information, still further operable to convert n3 bits of gray level information for a high gray level region into m3 (<n3) bits of gray level information, and still further operable to convert a gray level of an input video signal so that m1≦m2, m3≦m2 and n1+n2+n3>m1+m2+m3 are all satisfied;

a first power consumption calculation unit operable to calculate power consumption for an input video signal prior to gray level conversion;

a second power consumption calculation unit operable to calculate power consumption for an input video signal following gray level conversion; and a peak brightness control unit operable to issue an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion.

16. Electronic equipment comprising:

a region-adaptive gray level conversion unit operable to convert n1 bits of gray level information for a low gray level region into m1 (<n1) bits of gray level information, further operable to convert n2 bits of gray level information for an intermediate gray level region into m2 (≦n2) bits of gray level information, still further operable to convert n3 bits of gray level information for a high gray level region into m3 (<n3) bits of gray level information, and still further operable to convert a gray level of an input video signal so that m1≦m2, m3≦m2 and n1+n2+n3>m1+m2+m3 are all satisfied;

a first power consumption calculation unit operable to calculate power consumption for an input video signal prior to gray level conversion;

a second power consumption calculation unit operable to calculate power consumption for an input video signal following gray level conversion;

a peak brightness control unit operable to issue an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion; and a display device operable to display, on a screen, an image for an input video signal following gray level conversion.

17. A power consumption reduction method comprising the step of:

converting n1 bits of gray level information for a low gray level region into m1 (<n1) bits of gray level information, n2 bits of gray level information for an intermediate gray level region into m2 (≦n2) bits of gray level information, and n3 bits of gray level information for a high gray level region into m3 (<n3) bits of gray level information under the condition where $m1 \leqq m2$, $m3 \leqq m2$ and $n1+n2+n3>m1+m2+m3$ are all satisfied;

a first power consumption calculation step of calculating power consumption for an input video signal prior to gray level conversion;

a second power consumption calculation step of calculating power consumption for an input video signal following gray level conversion; and a peak brightness control step of issuing an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion.

18. A visibility improvement method comprising:

a region-adaptive gray level conversion step of converting n1 bits of gray level information for a low gray level region into m1 ($<n1$) bits of gray level information, n2 bits of gray level information for an intermediate gray level region into m2 ($\leqq n2$) bits of gray level information, and n3 bits of gray level information for a high gray level region into m3 ($<n3$) bits of gray level information under the condition where $m1 \leqq m2$, $m3 \leqq m2$ and $n1+n2+n3>m1+m2+m3$ are all satisfied;

a first power consumption calculation step of calculating power consumption for an input video signal prior to gray level conversion;

a second power consumption calculation step of calculating power consumption for an input video signal following gray level conversion; and a peak brightness control step of issuing an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion.

19. A computer program product comprising a non-transitory computer readable medium including program code stored thereon, said program code being executable to perform operations comprising:

a region-adaptive gray level conversion step of converting n1 bits of gray level information for a low gray level region into m1 ($<n1$) bits of gray level information, n2 bits of gray level information for an intermediate gray level region into m2 ($\leqq n2$) bits of gray level information, and n3 bits of gray level information for a high gray level region into m3 ($<n3$) bits of gray level information under the condition where $m1 \leqq m2$, $m3 \leqq m2$ and $n1+n2+n3>m1+m2+m3$ are all satisfied;

a first power consumption calculation step of calculating power consumption for an input video signal prior to gray level conversion;

a second power consumption calculation step of calculating power consumption for an input video signal following gray level conversion; and a peak brightness control step of issuing an instruction to increase the peak brightness level of a self-luminous display device so that power consumption following gray level conversion remains equal to or below power consumption prior to gray level conversion, wherein the peak brightness control unit determines a rate of increase in peak brightness level based on a value obtained by dividing power consumption prior to gray level conversion by power consumption following gray level conversion.

* * * * *